US006946424B2

(12) United States Patent
Ieshige et al.

(10) Patent No.: US 6,946,424 B2
(45) Date of Patent: Sep. 20, 2005

(54) THERMAL TRANSFER SHEET

(75) Inventors: Munenori Ieshige, Shinjuku-Ku (JP); Naohiro Obonai, Tokyo-To (JP); Kenichi Hirota, Shinjuku-Ku (JP); Takenori Omata, Shinjuku-Ku (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 112 days.

(21) Appl. No.: 10/368,476

(22) Filed: Feb. 20, 2003

(65) Prior Publication Data

US 2003/0181331 A1 Sep. 25, 2003

(30) Foreign Application Priority Data

| | | |
|---|---|---|
| Feb. 20, 2002 | (JP) | 2002-042580 |
| Jun. 18, 2002 | (JP) | 2002-176982 |
| Jun. 21, 2002 | (JP) | 2002-181812 |
| Dec. 27, 2002 | (JP) | 2002-379319 |

(51) Int. Cl.[7] ..... B41M 5/40

(52) U.S. Cl. ..... 503/227; 428/32.77; 428/32.78; 428/32.79

(58) Field of Search ..... 428/32.77, 32.78, 428/32.79; 503/227

(56) References Cited

U.S. PATENT DOCUMENTS

| | | | | |
|---|---|---|---|---|
| 4,995,741 A | 2/1991 | Mecke et al. | ..... | 400/120 |
| 5,346,931 A | 9/1994 | Hoffmann | ..... | 523/201 |

FOREIGN PATENT DOCUMENTS

| | | |
|---|---|---|
| EP | 0 513 800 A1 | 11/1992 |
| EP | 0 930 173 A1 | 7/1999 |

*Primary Examiner*—Bruce H. Hess
(74) *Attorney, Agent, or Firm*—Oliff & Berridge, PLC

(57) ABSTRACT

The present invention is first directed to a thermal transfer sheet which is not high in cost for obtaining a substrate, does not involve a problem of blocking or the like at the time of winding after coating of a backside layer onto the substrate, can eliminate the need to provide a release layer on the protective layer region, and further can enhance glossiness of a print with a protective layer. The thermal transfer sheet comprises a substrate, a dye layer of at least one color and a thermally transferable protective layer provided in a face serial manner on one side of the substrate, a protective layer provided on a part of one side of the substrate, an easy-adhesion layer provided on the whole surface of the protective layer and the substrate, the dye layer being provided on the easy-adhesion layer in its region where the protective layer is not located on the underside of the easy-adhesion layer. The second invention is directed to a thermal transfer sheet which can cope with increased printing speed in the thermal transfer, can meet demands for the provision of thermally transferred images having high density and high quality, can prevent the occurrence of abnormal transfer, cockles, etc., and can improve sensitivity in transfer at the time of printing. The thermal transfer sheet according to the second invention comprises a substrate, a heat-resistant slip layer provided on one side of the substrate, and an adhesive layer and a dye layer provided in that order on the other side of the substrate, the adhesive layer comprising a polyvinylpyrrolidone resin. By virtue of this construction, the sensitivity in transfer can be significantly improved at the time of thermal transfer, and a high-density thermally transferred image can be provided without applying high energy.

11 Claims, 3 Drawing Sheets

THERMAL TRANSFER SHEET

TECHNICAL FIELD

The present invention relates to a thermal transfer sheet comprising a substrate and dye layers of at least one color and a thermally transferable protective layer provided in a face serial manner on one side of the substrate, and more particularly relates to such a thermal transfer sheet that an easy-adhesion layer is coated later on a raw substrate.

Further, the present invention relates to a thermal transfer sheet comprising a substrate, a heat-resistant slip layer provided on one side of the substrate, and an adhesive layer and a dye layer provided in that order on the other side of the substrate, and more particularly to a thermal transfer sheet which has high sensitivity in transfer at the time of printing and can prevent abnormal transfer, for example, transfer of the dye layer together with the dye at the time of printing on an object.

BACKGROUND ART

First Invention

Gradation images and monotone images, such as characters and symbols, have hitherto been formed on image-receiving sheets by thermal transfer methods. Conventional thermal transfer methods include a thermal dye sublimation transfer method and a thermal ink transfer method. In the thermal dye sublimation transfer method, a thermal transfer sheet comprising a substrate and, supported on the substrate, a dye layer formed of a sublimable dye as a coloring material dissolved or dispersed in a binder resin is first put on top of an image-receiving sheet. Energy corresponding to image information is applied to the assembly by heating means, such as a thermal head or a laser beam, to transfer the dye contained in the sublimable dye layer in the thermal transfer sheet onto the image-receiving sheet, whereby an image is formed on the image-receiving sheet. In the thermal dye sublimation transfer method, since the amount of the dye transferred can be regulated dot by dot according to the quantity of energy applied to the thermal transfer sheet, gradational full-color images can be formed, and images having high quality comparable to images formed by silver salt photography can be formed. Therefore, the thermal dye sublimation transfer method has received attention and has been utilized as information recording means in various fields.

The development of various hardwares and softwares associated with multimedia has led to the expansion of the market of the thermal transfer method as a full-color hard copy system for computer graphics, static images through satellite communication, digital images typified, for example, by images of CD-ROMs (compact disc read only memory), and analog images, such as video images. Specific applications of the image-receiving sheet used in the thermal transfer method are various, and representative examples thereof include proofs of printing, output of images, output of plans and designs, for example, in CAD/CAM, output of various medical analytical instruments and measuring instruments, such as CT scans and endoscope cameras, alternative to instant photographs, output and printing of photograph-like images of a face or the like onto identity certifications or ID cards, credit cards, and other cards, and composite photographs and commemorative photographs, for example, in amusement facilities, such as amusement parks, game centers (amusement arcades), museums, and aquaria.

For images formed by the thermal dye sublimation transfer method, however, as compared with images formed by silver salt photography, fastness or resistance properties such as lightfastness and abrasion resistance are not very good.

To overcome this drawback, as one means for enhancing the fastness or resistance properties of images formed by the transfer recording method, a method has been proposed wherein the image is covered with a protective layer which has been formed using a protective layer transfer sheet comprising a thermally transferable protective layer provided on a substrate. In this case, when a thermal transfer sheet comprising a dye layer for image formation and the protective layer coated separately from each other in a face serial manner on an identical substrate is once set in a thermal transfer printer, a thermally transferred image and a thermally transferred protective layer provided on the image can be simply formed.

When the protective layer and the dye layer are provided on an identical substrate, however, at the time of the formation of a thermally transferred dye image on an image-receiving sheet, disadvantageously, the dye layer is often transferred together with the dye on the image-receiving sheet. In order to avoid this unfavorable abnormal transfer phenomenon, the adhesion between the substrate and the dye layer should be high. On the other hand, the protective layer should be separable from the substrate at the time of the thermal transfer of the protective layer onto the image in the print. When the dye layer and the protective layer are provided on an identical substrate, the following method has been commonly used in the art. At the outset, a substrate subjected to easy-adhesion treatment is provided, or alternatively, an easy-adhesion layer is provided on a substrate to enhance the adhesion of the substrate to a dye layer. Further, a release layer is provided on the substrate side in its region where the protective layer is provided, and the protective layer is then provided on the release layer.

In the case of the easy-adhesion treated substrate, since the easy-adhesion treatment is incorporated in a process such as a stretching process in the preparation of a substrate, a very thin easy-adhesion layer may be formed and satisfactory adhesion can be imparted to the substrate, but on the other hand, the cost for obtaining the raw substrate is very high and, in addition, problems such as blocking are likely to occur at the time of winding after coating of the backside layer onto the substrate.

Further, in the thermal transfer of a protective layer onto a print from a thermal transfer sheet formed by coating a release layer and a protective layer in that order on the substrate, the transferred protective layer is separated at the interface of the protective layer and the release layer. Therefore, in the print with the protective layer, the smoothness of the surface of the protective layer is poor, and it is difficult to provide a high-gloss print.

Accordingly, an object of the first invention is to solve the above problems of the prior art and to provide a thermal transfer sheet comprising a substrate and dye layers of at least one color and a thermally transferable protective layer provided in a face serial manner on one side of the substrate, which thermal transfer sheet is not high in cost for obtaining a substrate, does not involve a problem of blocking or the like at the time of winding after coating of a backside layer onto the substrate, can eliminate the need to provide a release layer on the protective layer region, and further can enhance glossiness of a print with a protective layer.

Second Invention

Various thermal transfer recording methods are known in the art. Among others, a method for forming various full-color images has been proposed. In this method, a thermal transfer sheet comprising dye layers formed by holding, by a suitable binder, dyes as recording materials for dye sublimation transfer on a substrate such as a polyester film is provided, and the sublimable dyes are thermally transferred from the thermal transfer sheet onto a thermal transfer image-receiving sheet comprising a dye-receptive layer provided on an object dyeable with a sublimable dye, for example, paper or plastic film to form a full-color image. In this case, a large number of color dots of three or four colors with the quantity of heat being regulated are transferred by heating by means of a thermal head as heating means in a printer onto a receptive layer in the thermal transfer image-receiving sheet to reproduce a full color of an original by the multicolor dots. In this method, since coloring materials used are dyes, the formed images are very sharp and are highly transparent and thus are excellent in reproduction of intermediate colors and in gradation and are comparable with images formed by conventional offset printing or gravure printing. At the same time, this method can form high-quality images comparable with full-color images formed by photography.

In the thermal transfer recording method utilizing the thermal dye sublimation transfer, an increase in printing speed of thermal transfer printers has posed a problem that conventional thermal transfer sheets cannot provide satisfactory print density. Further, higher density and higher sharpness have become required of prints of images formed by thermal transfer. To meet this demand, various attempts have been made to improve thermal transfer sheets and thermal transfer image-receiving sheets which receive sublimable dyes transferred from the thermal transfer sheets to form images.

For example, an attempt to improve the sensitivity in transfer at the time of printing has been made by reducing the thickness of the thermal transfer sheet. This, however, poses a problem that cockling occurs due to heat, pressure or the like applied at the time of the production of the thermal transfer sheet or at the time of thermal transfer recording and, in some cases, breaking of the thermal transfer sheet occurs.

Further, an attempt to improve the print density and the sensitivity in transfer at the time of printing has been made by increasing the dye/binder ratio in the dye layer of the thermal transfer sheet. In this case, however, during storage in a wound state, the dye is transferred onto the heat-resistant slip layer provided on the backside of the thermal transfer sheet, and, at the time of rewinding, the dyes transferred onto the heat-resistant slip layer is retransferred onto dye layers of other colors or the like. That is, a kick back phenomenon occurs. When the contaminated layers are thermally transferred onto an image-receiving sheet, hue different from a designated one is provided, or otherwise the so-called "smudge" occurs.

To overcome the above problem, a proposal on a thermal transfer printer rather than the thermal transfer sheet side has been made. In this proposal, in thermal transfer at the time of image formation, high energy is applied in a thermal transfer printer. In this case, however, fusing of the dye layer to the receptive layer, that is, the so-called "abnormal transfer," is likely to occur. When a large amount of a release agent is added to the receptive layer for abnormal transfer prevention purposes, blurring, smudge and other unfavorable phenomena of the image occur.

Further, Japanese Patent Publication No. 102746/1995 discloses, as a prior art technique, a thermal transfer sheet wherein a hydrophilic barrier/subbing layer comprising polyvinylpyrrolidone as a main component and, mixed with the main component, polyvinyl alcohol as a component for enhancing dye transfer efficiency is provided between a dye layer and a support. The polyvinylpyrrolidone is added for preventing abnormal transfer and preventing sticking at the time of printing, and the polyvinyl alcohol functions to improve sensitivity in transfer. In this publication, there is no description on the usefulness of polyvinylpyrrolidone for improving the sensitivity in transfer.

As described above, to cope with an increase in printing speed at the time of thermal transfer and to meet the demand for higher density and higher quality of thermally transferred images, various proposals have been made on the regulation of the thermal transfer printer side and on an improvement in thermal transfer recording materials in thermal transfer sheets and thermal transfer image-receiving sheets used in the thermal transfer. These proposals, however, suffer from unsatisfactory printing density, abnormal transfer at the time of thermal transfer, and other problems. For the above reason, up to now, prints having satisfactorily high quality could not have been provided.

Accordingly, an object of the second invention is to solve the above problems of the prior art and to provide a thermal transfer sheet which can cope with increased printing speed in the thermal transfer, can meet demands for the provision of thermally transferred images having high density and high quality, can prevent the occurrence of abnormal transfer, cockles, etc., and can further improve sensitivity in transfer at the time of printing.

DISCLOSURE OF THE INVENTION

First Invention

The above object of the present invention can be attained by a thermal transfer sheet comprising: a substrate; a dye layer of at least one color and a thermally transferable protective layer provided in a face serial manner on one side of the substrate; a protective layer provided on a part of one side of the substrate; and an easy-adhesion layer provided on the whole surface of the protective layer and the substrate, the dye layer being provided on the easy-adhesion layer in its region where the protective layer is not located on the underside of the easy-adhesion layer.

Preferably, the easy-adhesion layer comprises a homopolymer of N-vinylpyrrolidone and/or a copolymer of N-vinylpyrrolidone with other component(s).

Preferably, an adhesive layer is provided on the easy-adhesion layer in its region where the protective layer is located on the underside of the easy-adhesion layer.

Preferably, a detection mark is provided between the dye layer and the thermally transferable protective layer and/or between the dye layer of a plurality of colors. The provision of the detection mark is useful for registration at the time of coating of the dye layer and the thermally transferable protective layer on the substrate in a face serial manner. Further, in the thermal transfer onto an image-receiving sheet using this thermal transfer sheet, the thermally transferred image and the thermally transferable protective layer can be accurately registered with the image-receiving sheet by detecting the detection mark by a printer to accurately read the thermal transfer sheet in its region to be transferred.

Second Invention

The second invention provides a thermal transfer sheet comprising: a substrate; a heat-resistant slip layer provided on one side of the substrate; and an adhesive layer and a dye layer provided in that order on the other side of the substrate, the adhesive layer comprises a polyvinylpyrrolidone resin.

In a preferred embodiment of the present invention, the polyvinylpyrrolidone resin has a K value in the Fickencher's formula of not less than 60.

In the present invention, the adhesive layer may comprise other adhesive component(s) in addition to the polyvinylpyrrolidone resin.

The adhesive component is preferably contained in an amount of 1 to 30% by weight on a solid basis of the whole adhesive layer.

In the present invention, the substrate on its surface where the dye layer is provided may have been subjected to adhesion treatment.

The present invention, however, includes an embodiment wherein the substrate on its surface where the dye layer is provided has not been subjected to adhesion treatment.

In the thermal transfer sheet according to the second invention comprising a substrate, a heat-resistant slip layer provided on one side of the substrate, and an adhesive layer and a dye layer provided in that order on the other side of the substrate, since the adhesive layer comprises a polyvinylpyrrolidone resin, the sensitivity in transfer can be significantly improved at the time of thermal transfer, and a high-density thermally transferred image can be provided without applying high energy. When the adhesive layer comprises other adhesive component(s) in addition to the polyvinylpyrrolidone resin, the adhesion between the dye layer and the substrate can be enhanced and abnormal transfer and the like can be prevented.

BEST MODE FOR CARRYING OUT THE INVENTION

First Invention

The first invention will be described in more detail with reference to the following preferred embodiments.

Figure 1:
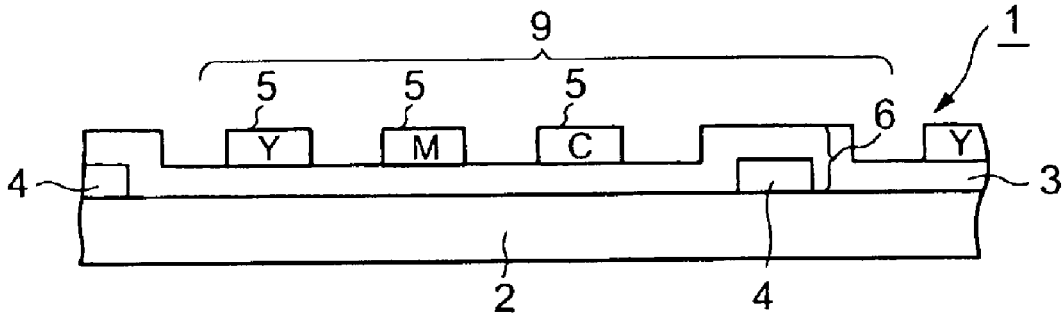
FIG. 1 is a schematic cross-sectional view showing one embodiment of the thermal transfer sheet according to the first invention.

FIG. 1 is a schematic cross-sectional view showing one embodiment of a thermal transfer sheet 1 according to the present invention. In the thermal transfer sheet 1, a protective layer 4 is provided on a part of one side of a substrate 2. An easy-adhesion layer 3 is provided on the whole surface of the protective layer 4 and the substrate 2 in its region not provided with the protective layer 4. Dye layers 5, i.e., a yellow dye layer (Y), a magenta dye layer (M), and a cyan dye layer (C), are provided in a face serial manner on the easy-adhesion layer 3 in its region between two adjacent protective layers 4, that is, in its region where the protective layer 4 is not provided on the underside of the easy-adhesion layer 3. The region, where the protective layer 4 and the easy-adhesion layer 3 are stacked onto the substrate 2, constitutes a thermally transferable protective layer 6. Upon heating of this region, the thermally transferable protective layer 6 composed of the two layers is transferred onto an object. In the thermal transfer sheet 1, a unit 9 composed of the dye layers 5 of three colors and the thermally transferable protective layer 6 is repeatedly provided in the longitudinal direction of the thermal transfer sheet 1.

Figure 2:
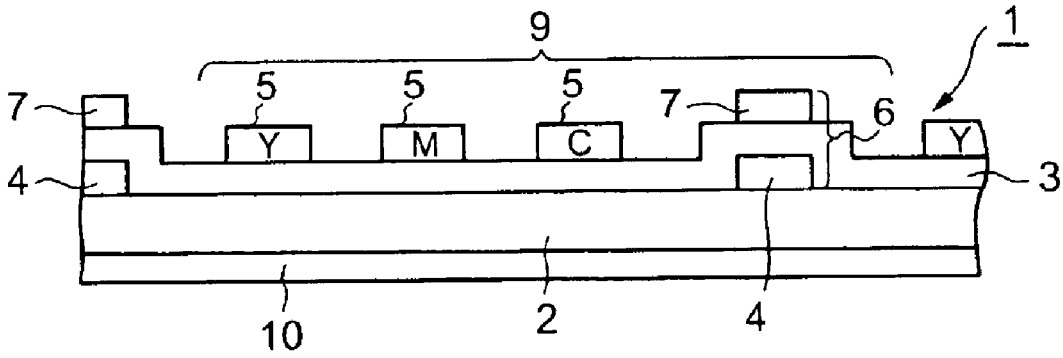
FIG. 2 is a schematic cross-sectional view showing another embodiment of the thermal transfer sheet according to the first invention.

FIG. 2 is a schematic cross-sectional view showing another embodiment of a thermal transfer sheet 1 according to the present invention. In the thermal transfer sheet 1, a protective layer 4 is provided on a part of one side of a substrate 2. An easy-adhesion layer 3 is provided on the whole surface of the protective layer 4 and the substrate 2 in its region where the protective layer 4 is not provided on the substrate 2. An adhesive layer 7 is provided on the easy-adhesion layer 3 in its region where the protective layer 4 is located on the underside of the easy-adhesion layer 3. In this case, three layers of the protective layer 4, the easy-adhesion layer 3, and the adhesive layer 7 constitute a thermally transferable protective layer 6 which is transferred onto an object. A heat-resistant slip layer 10 is provided on the surface of the substrate 2 remote from the protective layer 4, for example, from the viewpoints of preventing fusing of the substrate to a thermal head and of improving the traveling property of the thermal transfer sheet. Since the adhesive layer 7 is present as the outermost layer in the thermally transferable protective layer 6, the transferability and adhesion of the thermally transferable protective layer to an object can be improved. Dye layers 5, i.e., a yellow dye layer (Y), a magenta dye layer (M), and a cyan dye layer (C), are provided in a face serial manner on the easy-adhesion layer 3 in its region between two adjacent thermally transferable protective layers 6, that is, in its region where the thermally transferable protective layer 6 is not provided. In the thermal transfer sheet 1, a unit 9 composed of the dye layers 5 of three colors and the thermally transferable protective layer 6 is repeatedly provided in the longitudinal direction of the thermal transfer sheet 1.

Figure 3:
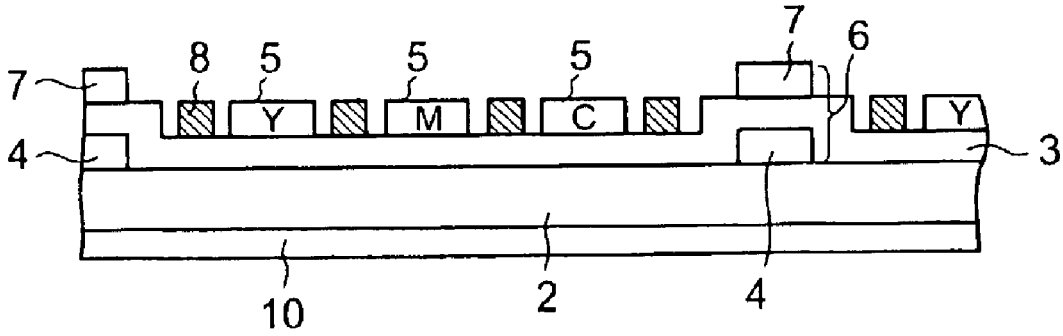
FIG. 3 is a schematic cross-sectional view showing a further embodiment of the thermal transfer sheet according to the first invention.

FIG. 3 is a schematic cross-sectional view showing another embodiment of a thermal transfer sheet 1 according to the present invention. The construction of the thermal transfer sheet shown in FIG. 3 is the same as that of the thermal transfer sheet shown in FIG. 2, except that a detection mark 8 is additionally provided between the yellow dye layer (Y) and the magenta dye layer (M), between the magenta dye layer (M) and the cyan dye layer (C), between the cyan dye layer (C) and the thermally transferable protective layer 6, and between the thermally transferable protective layer 6 and the yellow dye layer (Y).

Each element constituting the thermal transfer sheet according to the first invention will be described.

(Substrate)

The substrate 2 used in the thermal transfer sheet according to the present invention may be any conventional substrate so far as the substrate has certain level of heat resistance and strength. Substrates usable herein include, for example, papers having a thickness of about 0.5 to 50 μm, preferably about 2 to 10 μm, various converted papers, and films of polyester, polypropylene, cellophane, polycarbonate, cellulose acetate, polyethylene, polyvinyl chloride, polystyrene, nylon, polyimide, polyvinylidene chloride, polyvinyl alcohol, polyphenylene sulfide, aramid, and fluororesin. A composite of two or more of the above materials may also be used. Among them, a polyester film is preferred, and a polyethylene terephthalate film is particularly preferred.

The above substrate may be subjected to adhesion treatment, such as corona discharge treatment, plasma treatment, low-temperature plasma treatment, flame treatment, ozone treatment, ultraviolet treatment, radiation treatment, roughening treatment, or chemical treatment, from the viewpoint of enhancing the adhesion between the substrate and the layer provided on the substrate.

(Easy-Adhesion Layer)

Preferred resins usable for constituting the easy-adhesion layer 3 in the thermal transfer sheet according to the present invention include polyester resins, acrylic resins, urethane resins, alkyd resins, homopolymers of N-vinylpyrrolidone, and copolymers of N-vinylpyrrolidone with other component(s). In order to improve the adhesion to the substrate or the dye layer and the protective layer or to improve environmental stability, the addition of a melamine compound, an isocyanate compound, an epoxy compound, an oxazoline group-containing compound, a chelate compound or the like to the easy-adhesion layer is preferred.

Examples of N-vinylpyrrolidone include: N-vinyl-2-pyrrolidone, N-vinyl-3-pyrrolidone, and N-vinyl-4-pyrrolidone; and homopolymers of N-vinylpyrrolidone (a homopolymer of single monomer species) and copolymers of different N-vinylpyrrolidone monomers.

The polyvinylpyrrolidone resin may be of a grade of 60 to 120 in terms of K value in the Fickencher's formula and has a number average molecular weight of about 30,000 to 280,000. The use of this polyvinylpyrrolidone resin in the easy-adhesion layer can improve the plasticizer resistance, the scratch resistance and the like of the thermally transferable protective layer and further can enhance the sensitivity in transfer and can prevent uneven transfer and a failure of transfer of the protective layer.

When the K value of the polyvinylpyrrolidone resin is less than 60 (K-15, K-30), the effect of improving the sensitivity in transfer at the time of printing cannot be attained.

Further, a copolymer of the N-vinylpyrrolidone with other copolymerizable monomer(s) may also be used. Copolymerizable monomers other than the N-vinylpyrrolidone include, for example, vinyl monomers such as styrene, vinyl acetate, acrylic ester, acrylonitrile, maleic anhydride, vinyl chloride (fluoride), and vinylidene chloride (fluoride, cyanide). A copolymer produced by radical copolymerization of the vinyl monomer with N-vinylpyrrolidone may be used. Further, for example, block copolymers or graft copolymers of polyester resin, polycarbonate resin, polyurethane resin, epoxy resin, acetal resin, butyral resin, formal resin, phenoxy resin, cellulose resin or the like with the polyvinylpyrrolidone may also be used.

In addition to the polyvinylpyrrolidone resin, other resin(s) may be incorporated in the easy-adhesion layer to improve the adhesion. Other resins usable herein include: polymers (copolymers) produced from vinyl monomers, such as styrene, vinyl acetate, acrylic ester, acrylonitrile, maleic anhydride, vinyl chloride (fluoride), and vinylidene chloride (fluoride, cyanide); polyester resin; polycarbonate resin; polyurethane resin; epoxy resin; acetal resin; butyral resin; formal resin; phenoxy resin; cellulose resin; and polyvinyl alcohol resin. This resin component is preferably added in an amount of 1 to 30% by weight based on the solid content of the whole easy-adhesion layer. When the amount of the resin component added is below the lower limit of the above defined range, no satisfactory adhesion can be provided. On the other hand, when the amount of the resin component added is above the upper limit of the above defined range, the effect of improving the sensitivity in transfer cannot be satisfactorily attained by the addition of the polyvinylpyrrolidone.

An organic ultraviolet absorber or an inorganic ultraviolet absorber may be added to the easy-adhesion layer to improve the lightfastness of the protective layer. Organic ultraviolet absorbers usable herein include, for example, nonreactive ultraviolet absorbers such as salicylate, benzophenone, benzotriazole, triazine, substituted acrylonitrile, nickel chelate, or hindered amine nonreactive ultraviolet absorbers. Further, a product produced by introducing, for example, an addition-polymerizable double bond, such as a vinyl, acryloyl, or methacryloyl group, or an alcoholic hydroxyl, amino, carboxyl, epoxy, isocyanate or other group, into the nonreactive ultraviolet absorber, and copolymerizing the nonreactive ultraviolet absorber with the above group introduced thereinto with a thermoplastic resin, such as an acrylic resin, or grafting the nonreactive ultraviolet absorber with the above group introduced thereinto onto the thermoplastic resin may also be used. Among these ultraviolet absorbers, benzophenone, benzotriazole, and triazine ultraviolet absorbers are particularly preferred because of high ultraviolet absorption capability.

Further, preferably, depending upon the properties of dyes used in the formation of an image, ultraviolet absorbers different from each other in system may be used in combination so as to cover an available ultraviolet absorption wavelength range. Regarding nonreactive ultraviolet absorbers, the use of a mixture of a plurality of nonreactive ultraviolet absorbers different from each other in structure is preferred from the viewpoint of preventing the precipitation of the ultraviolet absorbers.

Inorganic ultraviolet absorbers usable herein include fillers having an ultraviolet absorption capability, such as titanium oxide, zinc oxide, and cerium oxide fillers. In addition to the above inorganic fillers as the ultraviolet absorber, other fillers such as fillers of silica, alumina or other metal oxides and metal sulfides may also be used from the viewpoint of improving the adhesion and other properties. These fillers are preferably fine particles having an average particle diameter of not more than 0.1 μm from the viewpoint of maintaining the transparency of the protective layer.

The easy-adhesion layer may be formed as follows. The above materials are first dissolved or dispersed, for example, in a solvent, such as acetone, methyl ethyl ketone, toluene, xylene, or alcohol, or water selected according to suitability for coating to prepare a coating liquid. The coating liquid is then coated onto the surface of the substrate by conventional coating means such as a gravure coater, a die coater, a roll coater, or a wire. The coating is then dried and solidified to form an easy-adhesion layer. The coverage of the easy-adhesion layer on a dry basis is 0.01 to 5 $g/m^2$, preferably 0.02 to 1 $g/m^2$, more preferably 0.02 to 0.5 $g/m^2$. An easy-adhesion layer having a thickness of no more than 0.5 $g/m^2$ is preferable in terms of the improvement of thermal sensitivity.

(Protective Layer)

The easy-adhesion layer, the protective layer 4, and, in addition, the adhesive layer may be mentioned as layers constituting the thermally transferable protective layer 6 in the thermal transfer sheet according to the present invention.

The protective layer mainly functions to impart fastness or resistance properties such as lightfastness and abrasion resistance. Various resins known as resins for protective layer formation in the art may be used as the resin for constituting the protective layer. Examples of resins for protective layer formation include: polyester resins; polystyrene resins; acrylic resins; polyurethane resins; acrylated urethane resins; polyvinylpyrrolidone resins as described above in connection with the easy-adhesion layer; silicone modification products of the above resins; mixtures of the above resins; ionizing radiation-curable resins; and ultraviolet screening resins.

A protective layer containing an ionizing radiation-cured resin is particularly excellent in plasticizer resistance and scratch resistance. The ionizing radiation-curable resin for this purpose may be any conventional one. For example, a resin formed by crosslinking and curing a radically polymerizable polymer or oligomer through ionizing radiation irradiation and, if necessary, adding a photopolymerization initiator thereto, and then performing polymerization crosslinking by applying an electron beam or ultraviolet light may be used.

The protective layer containing an ultraviolet screening resin mainly functions to impart lightfastness to prints. An example of the ultraviolet screening resin usable herein is a resin formed by reacting a reactive ultraviolet absorber with a thermoplastic resin or the above-described ionizing radiation-curable resin to bond the ultraviolet absorber to the resin. More specifically, the ultraviolet screening resin may be, for example, a resin produced by introducing a reactive group, such as an addition-polymerizable double bond (for example, a vinyl, acryloyl, or methacryloyl group) or an alcoholic hydroxyl, amino, carboxyl, epoxy, or isocyanate group into a conventional nonreactive organic ultraviolet absorber, for example, a salicylate, benzophenone, benzotriazole, substituted acrylonitrile, nickel chelate, or hindered amine nonreactive organic ultraviolet absorber.

The protective layer may be provided on the substrate by preparing a coating liquid containing necessary ingredients, coating the coating liquid onto the substrate by conventional coating means, such as a gravure coater, a die coater, a roll coater, or a wire, and drying the coating. The coverage of the protective layer is generally about 0.5 to 10 g/m$^2$ on a dry basis, although the coverage varies depending upon the type of the resin for protective layer formation.

(Adhesive Layer)

An adhesive layer 7 may be provided as the uppermost layer in the thermally transferable protective layer in the thermal transfer sheet according to the present invention. That is, the adhesive layer 7 may be provided on the easy-adhesion layer in its region where the protective layer is located on the underside of the easy-adhesion layer. The adhesive layer can improve the transferability and adhesion of the thermally transferable protective layer onto an object. This adhesive layer may be formed of any conventional pressure-sensitive adhesive or heat-sensitive adhesive, preferably formed of a thermoplastic resin having a glass transition temperature of 50° C. to 80° C. Preferably, for example, a resin having a suitable glass transition temperature is selected from resins having good thermal adhesion, such as polyester resins, polycarbonate resins, butyral resins, acrylic resins, ultraviolet screening resins, epoxy resins, vinyl chloride-vinyl acetate copolymer resins, polyamide resins, and vinyl chloride resins. Further, the same polyvinylpyrrolidone resin as described above in connection with the easy-adhesion layer may be contained in the adhesive layer to improve the sensitivity in transfer of the protective layer.

The ultraviolet screening resin may be a resin, as described above in connection with the protective layer, produced by reacting a reactive ultraviolet absorber with a thermoplastic resin or an ionizing radiation-curable resin to bond the reactive ultraviolet absorber to the resin. The adhesive layer may contain inorganic fillers, such as finely divided silica, alumina, calcium carbonate, talc, and clay, and organic fillers, such as acrylic resins, polyester resins, melamine resins, epoxy resins, and polyethylene resins. The content of the filler in the adhesive layer is preferably about 0.1 to 30% in terms of resin solid content ratio in the adhesive layer. The average particle diameter of the filler is preferably about 1 to 10 $\mu$m. When the average particle diameter is less than 1 $\mu$m, the slipperiness of the thermal transfer sheet and the image-receiving sheet is deteriorated. Therefore, meandering and cockling are likely to occur at the time of the transfer of the protective layer. On the other hand, when the average particle diameter exceeds 10 $\mu$m, the transparency of the thermally transferable protective layer is lowered. As a result, disadvantageously, the underlying thermally transferred image becomes unclear.

Further, the same organic ultraviolet absorber or inorganic ultraviolet absorber as described above in connection with the easy-adhesion layer may be added to the adhesive layer to improve the lightfastness of the protective layer.

The adhesive layer is formed by coating a coating liquid with the resin for constituting the adhesive layer and optional additives added thereto and drying the coating. The coverage of the adhesive layer is preferably about 0.5 to 10 g/m$^2$ on a dry basis.

(Dye Layer)

The dye layer 5 provided in the thermal transfer sheet according to the present invention is a layer formed of a dye held by any binder. Dyes usable herein are dyes which, upon heating, are melted, diffused, or sublimation transferred. Any dye used in the conventional thermal transfer sheet can be effectively used in the present invention. The dye used, however, is selected by taking into consideration hue, lightfastness, and solubility in the binder. Examples of preferred dyes include: diarylmethane dyes; triarylmethane dyes; thiazole dyes; methine dyes such as merocyanine dyes; azomethine dyes typified by indoaniline, acetophenoneazomethine, pyrazoloazomethine, imidazoleazomethine, imidazoazomethine, and pyridoneazomethine dyes; xanthene dyes; oxazine dyes; cyanomethylene dyes typified by dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; spiropyran dyes; indolinospiropyran dyes; fluoran dyes; rhodaminelactam dyes; naphthoquinone dyes; anthraquinone dyes; and quinophthalone dyes.

Specific examples of dyes usable herein include:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 26, 36, 56, and 31;

C.I. Disperse Yellow 56, 14, 16, 29, and 201;

C.I. Solvent Blue 70, 35, 63, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3; and

C.I. Solvent Green 3.

For example, Kayaset Blue 714 (Solvent Blue 63, manufactured by Nippon Kayaku Co., Ltd.), Phorone Brilliant Blue S-R (Disperse Blue 354, manufactured by Sandoz K.K.), and Waxoline AP-FW (Solvent Blue 36, manufactured by ICI) may be used as cyan dyes. For example, MS Red G (Disperse Red 60, manufactured by Mitsui Toatsu Chemicals, Inc.), and Macrolex Violet R (Disperse Violet 26, manufactured by Bayer) may be used as magenta dyes. For example, Phorone Brilliant Yellow S-6 GL (Disperse Yellow 231, manufactured by Sandoz K.K.) and Macrolex Yellow 6G (Disperse Yellow 201, manufactured by Bayer) may be used as yellow dyes.

Any conventional resin binder may be used for holding the above dyes, and examples of resin binders include: cellulosic resins such as ethylcellulose, ethylhydroxycellulose, hydroxypropylcellulose, methylcellulose, and cellulose acetate; vinyl resins such as polyvinyl alcohol, polyvinyl acetate, polyvinyl butyral, polyvinyl acetal, and polyvinylpyrrolidone; acrylic resins such as poly(meth)acrylate and poly(meth)acrylamide; polyurethane resins; polyamide resins; and polyester resins. The resin binders may be used either solely or as a mixture of two or more. Among them, polyvinylbutyral and polyvinylacetal are preferred from the viewpoint of transferability of dyes and storage stability of the thermal transfer sheet.

Further, in the present invention, instead of the binder resin, the following releasable graft copolymers may be used as a release agent or a resin binder. The releasable graft copolymers are such that at least one releasable segment selected from a polysiloxane segment, a hydrocarbon fluoride segment, a carbon fluoride segment, and a long-chain alkyl segment has been graft polymerized to the main chain of a polymer.

Among them, a graft copolymer produced by grafting a polysiloxane segment onto the main chain of a polyvinyl acetal resin is particularly preferred. This graft copolymer may be produced, for example, by reacting polysiloxane having a functional group with diisocyanate to produce a silicone chain for grafting and grafting the silicone chain for grafting onto polyvinyl acetal. More specifically, the silicone chain for grafting may be produced, for example, by reacting hexamethylene diisocyanate with dimethylpolysiloxane having a hydroxyl group at its one end in a mixed solvent composed of methyl ethyl ketone and methyl isobutyl ketone in a ratio of 1:1 in the presence of a tin-base catalyst, for example, dibutyltin at a reaction temperature of about 0.01 to 100° C.

Next, this silicone chain for grafting may be reacted with a polyvinyl acetal resin in a mixed solvent composed of methyl ethyl ketone and methyl isobutyl ketone in a ratio of 1:1 to produce a silicone-grafted polyvinyl acetal resin.

When the graft copolymer is added as a release agent to the dye layer, the content of the releasable segment in the release agent is preferably 10 to 80% by weight based on the graft copolymer. When the content of the releasable segment is below the lower limit of the above defined range, the releasability is unsatisfactory. On the other hand, when the content of the releasable segment is above the upper limit of the above defined range, the compatibility of the release agent with the resin binder is lowered and, consequently, a problem associated, for example, with the transferability of the dye disadvantageously occurs. Release agents may be used to the dye layer either solely or as a mixture of two or more. The amount of the release agent added is preferably 1 to 40 parts by weight based on 100 parts by weight of the resin binder. When the amount of the release agent added is below the lower limit of the above defined range, the releasing effect is unsatisfactory. When the amount of the release agent added is above the upper limit of the above defined range, the transferability of the dye in the dye layer or the film strength is lowered. Further, in this case, disadvantageously, problems associated with a color change of dye in the dye layer and storage stability of the thermal transfer sheet occur. On the other hand, when the graft copolymer is used as the resin binder for the dye layer, the content of the releasable segment in the resin binder is preferably 0.5 to 40% by weight. When the content of the releasable segment is below the lower limit of the above defined range, the releasability of the dye layer is unsatisfactory. On the other hand, when the content of the releasable segment is above the upper limit of the above defined range, the transferability of dye in the dye layer and the strength of resin film are deteriorated. Further, in this case, disadvantageously, problems associated with a color change of dye in the dye layer and storage stability of the thermal transfer sheet occur.

The dye layer is preferably formed by adding the above dye and resin binder and optionally various additives, dissolving the mixture in a suitable organic solvent to prepare a solution or dispersing the mixture in an organic solvent or water to prepare a dispersion, coating the solution or dispersion onto the substrate by formation means such as gravure printing, screen printing, or reverse roll coating using a gravure plate, and drying the coating. In this case, the dye layer may be formed by single or double coating. The adoption of the double coating can enhance dye density per unit area. When the outermost layer of the dye layer is a layer containing the above releasable resin, heat fusing can be prevented even in the case of printing onto an image-receiving object such as a plastic card having a low release component content. The coverage on a dry basis of the dye layer is suitably about 0.2 to 5.0 g/m$^2$, preferably about 0.3 to 2.0 g/m$^2$. This printing may be single color printing. However, multicolor printing of three colors of yellow, magenta, and cyan or four colors of yellow, magenta, cyan, and black is preferred because full-color images can be formed.

(Heat-Fusion Ink Layer)

The thermal transfer sheet according to the present invention comprises a substrate and dye layers of at least one color and a thermally transferable protective layer provided in a face serial manner on one side of the substrate. On the substrate in its side where the dye layer is formed, the dye layer, a heat-fusion ink layer, and the thermally transferable protective layer may also be provided in that order in a face serial manner. More specifically, the heat-fusion ink layer portion is a laminate of substrate/easy-adhesion layer/heat-fusion ink layer. In the formation of the heat-fusion ink layer, if necessary, for example, a release layer for a heat-fusion ink layer may be formed on the easy-adhesion layer. Next, a heat-fusion ink containing a suitable colorant, a vehicle, and other additives is coated thereon by a conventional method such as hot-melt coating, hot lacquer coating, gravure coating, gravure reverse coating, or roll coating. The coverage of the heat-fusion ink layer is generally about 0.2 to 10 g/m$^2$ on a dry basis.

The colorant in the heat-fusion ink layer is preferably a black colorant because the black colorant is convenient mainly for recording high-density and clear characters, symbols and the like. Vehicles usable herein include, for example, waxes and mixtures of waxes with drying oils, resins, mineral oils, celluloses, rubber derivatives or the like. Waxes include, for example, microcrystalline wax, carnauba wax, paraffin wax, Fischer-Tropsh wax, low-molecular weight polyethylene, Japan wax, beeswax, spermaceti, insect wax, wool wax, shellac wax, candelilla wax, petrolatum, partially modified wax, fatty esters, and fatty amides.

(Heat-Resistant Slip Layer)

A heat-resistant slip layer 10 having heat-resistant slipperiness and releasability is preferably provided on the substrate in its side remote from the dye layer, that is, on the backside of the substrate, from the viewpoints of preventing fusing of the substrate to a thermal head and improving the traveling property of the thermal transfer sheet and, in addition, avoiding the sticking of the backside of the substrate to the surface of the dye layer and the thermally transferable protective layer upon winding of the thermal transfer sheet of the present invention in a roll form. Resins usable for heat-resistant slip layer formation include polyester resins, polyacrylic ester resins, polyvinyl acetate resins, styrene acrylate resins, polyurethane resins, polyolefin resins, polystyrene resins, polyvinyl chloride resins, polyether resins, polyamide resins, polyimide resins, polyamideimide resins, polycarbonate resins, polyethylene resins, polypropylene resins, polyacrylate resins, polyacrylamide resins, polyvinyl chloride resins, polyvinylbutyral resins, and polyvinyl acetoacetal resins.

Various crosslinking agents may be used to improve heat resistance, film properties, adhesion and other properties of the resin. Polyisocyanate and the like are generally used.

Further, release agents such as waxes, higher fatty amides, esters, and surfactants, organic powders such as fluororesin powders, and inorganic particles such as silica, clay, talc, mica, and calcium carbonate particles may be incorporated for traveling property improvement purposes.

(Detection Mark)

In the thermal transfer sheet according to the present invention, a detection mark 8 as shown in FIGS. 2 and 3 may be provided for indicating the start position of the formation of a thermally transferred image. The shape and color of the detection mark are not particularly limited so far as the mark can be detected with a detector (a sensor). Regarding the shape of the detection mark, for example, a stripe of a single line as shown in FIG. 2 and a combination of a stripe of a single line with a stripe of two lines as shown in FIG. 3 may be adopted. Further, a quadrangle, a circle or the like may be provided so as not to extend over the whole width of the thermal transfer sheet, that is, may be provided on a part of the width of the thermal transfer sheet. In this connection, it should be noted that, since the detection mark is provided for indicating the start position of the formation of the thermally transferred image, the detection mark is formed for each length corresponding to one block. Specifically, the detection mark may be provided at the head of each of all the dye layers and the thermally transferable protective layers provided in a face serial manner. Alternatively, the detection mark may be formed only in the first block in each of face serial units or only in a certain layer.

As described above, the color of the detection mark is not particularly limited so far as the mark can be detected with a detector. For example, in the case of a light transmission detector, silver, black or other colors having high covering power may be mentioned. On the other hand, in the case of a light reflection detector, for example, a metalescent color tone with high light reflection may be mentioned. The detection mark may be formed by any method without particular limitation. Examples of detection mark formation methods usable herein include: a conventional printing method such as gravure printing or offset printing is utilized; hot stamping using a transfer foil of a vapor-deposited film; and a method wherein a colored film or vapor-deposited film with a pressure-sensitive adhesive applied thereto is applied onto the backside.

Second Invention

Figure 6:
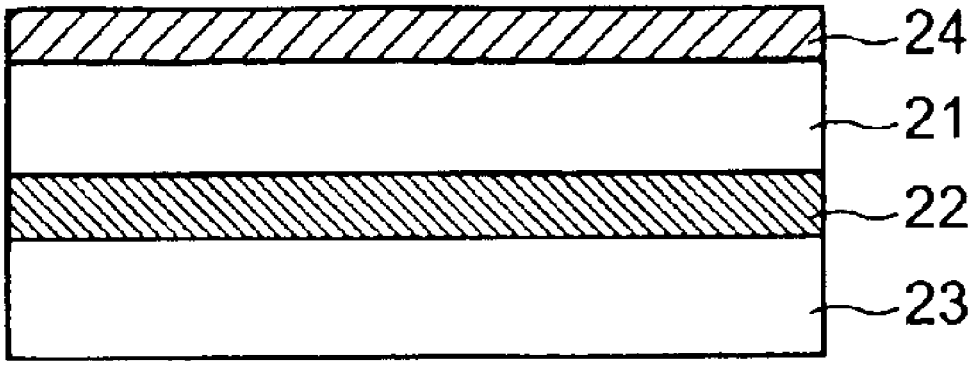
FIG. 6 is a schematic cross-sectional view showing one embodiment of the thermal transfer sheet according to the second invention.

FIG. 6 shows one embodiment of the thermal transfer sheet according to the second invention. A heat-resistant slip layer 24 is provided on one side of a substrate 21 to improve the slipperiness of a thermal head and, at the same time, to prevent sticking. An adhesive layer 22 comprising a polyvinylpyrrolidone resin and a dye layer 23 are provided in that order on the other side of the substrate 21.

Figure 7:
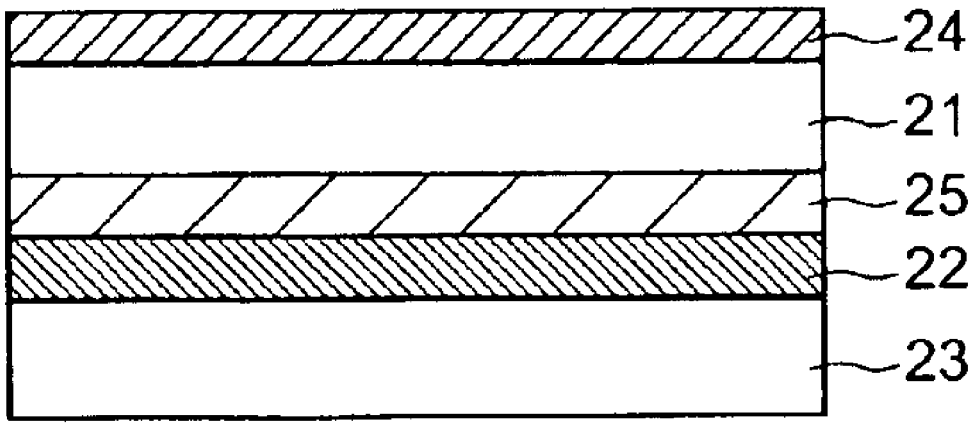
FIG. 7 is a schematic cross-sectional view showing another embodiment of the thermal transfer sheet according to the second invention.

FIG. 7 shows another embodiment of the thermal transfer sheet according to the second invention. A heat-resistant slip layer 24 is provided on one side of a substrate 21 to improve the slipperiness of a thermal head and, at the same time, to prevent sticking. A primer layer 25, an adhesive layer 22 comprising a polyvinylpyrrolidone resin, and a dye layer 23 are provided in that order on the other side of the substrate 21.

Each layer constituting the thermal transfer sheet according to the second invention will be described in detail.

(Substrate)

The substrate 21 used in the thermal transfer sheet according to the present invention may be any conventional substrate so far as the substrate has certain level of heat resistance and strength. Examples of substrates usable herein include about 0.5 to 50 $\mu$m-thick, preferably about 1 to 10 $\mu$m-thick, films of polyethylene terephthalate, 1,4-polycyclohexylene dimethylene terephthalate, polyethylene naphthalate, polyphenylene sulfide, polystyrene, polypropylene, polysulfone, aramid, polycarbonate, polyvinyl alcohol, cellulose derivatives, such as cellophane and cellulose acetate, polyethylene, polyvinyl chloride, nylon, polyimide, and ionomer.

The above substrate on its adhesive layer and dye layer forming side is often subjected to adhesion treatment. When an adhesive layer is coated onto a plastic film as the substrate, for example, the wettability of the plastic film by the coating liquid and the adhesion of the plastic film to the coating is often unsatisfactory. To overcome this drawback, adhesion treatment is carried out. Conventional resin surface modification techniques, such as corona discharge treatment, flame treatment, ozone treatment, ultraviolet treatment, radiation treatment, roughening treatment, chemical treatment, plasma treatment, low-temperature plasma treatment, primer treatment, and grafting treatment, as such may be applied to the adhesion treatment. These treatment methods may also be used in a combination of two or more. The primer treatment may be carried out, for example, by coating a primer liquid onto an unstretched film at the time of the formation of a plastic film by melt extrusion and then stretching the film.

Further, as the adhesion treatment of the substrate, a primer layer 5 may be formed by coating between the substrate and the adhesive layer. The primer layer may be formed of a resin. Resins usable for primer layer formation include: polyester resins; polyacrylic ester resins; polyvinyl acetate resins; polyurethane resins; styrene acrylate resins;

polyacrylamide resins; polyamide resins; polyether resins; polystyrene resins; polyethylene resins; polypropylene resins; vinyl resins such as polyvinyl chloride resins and polyvinyl alcohol resins; and polyvinyl acetal resins such as polyvinyl acetoacetal resins and polyvinyl butyral resins.

In the thermal transfer sheet comprising an adhesive layer and a dye layer provided in that order on a substrate according to the present invention, when the adhesive layer contains other adhesive component(s) in addition to the polyvinylpyrrolidone resin, a substrate not subjected to adhesion treatment may be used.

(Adhesive Layer)

The adhesive layer 22 provided between the substrate and the dye layer in the thermal transfer sheet according to the present invention is composed mainly of a polyvinylpyrrolidone resin and, if necessary, may further comprise 1 to 30% by weight, based on the solid content of the whole adhesive layer, of an adhesive component.

Polyvinylpyrrolidone resins usable herein include homopolymers or copolymers of vinylpyrrolidones such as N-vinyl-2-pyrrolidone and N-vinyl-4-pyrrolidone.

The polyvinylpyrrolidone resin used in the adhesive layer according to the present invention is preferably of a grade of not less than 60, particularly preferably 60 to 120, in terms of K value in the Fickencher's formula. The number average molecular weight of the polyvinylpyrrolidone resin is preferably about 30,000 to 280,000. When the K value of the polyvinylpyrrolidone resin is less than 60, the effect of improving the sensitivity in transfer at the time of printing is likely to be deteriorated.

Further, a copolymer of the above vinylpyrrolidone with other copolymerizable monomer(s) may also be used. Copolymerizable monomers other than the vinylpyrrolidone include, for example, vinyl monomers such as styrene, vinyl acetate, acrylic ester, acrylonitrile, maleic anhydride, vinyl chloride (fluoride), and vinylidene chloride (fluoride, cyanide). A copolymer produced by radical copolymerization of the vinyl monomer with the vinylpyrrolidone may be used. Further, for example, block copolymers or graft copolymers of polyester resin, polycarbonate resin, polyurethane resin, epoxy resin, acetal resin, butyral resin, formal resin, phenoxy resin, cellulose resin or the like with the polyvinylpyrrolidone may also be used.

In addition to the polyvinylpyrrolidone resin, an adhesive component may be incorporated in the adhesive layer to improve the adhesion between the substrate and the dye layer. Adhesive components usable herein include: polyester resins; polyacrylic ester resins; polyvinyl acetate resins; polyurethane resins; styrene acrylate resins; polyacrylamide resins; polyamide resins; polyether resins; polystyrene resins; polyethylene resins; polypropylene resins; vinyl resins such as polyvinyl chloride resins, vinyl chloride-vinyl acetate copolymer resins, and ethylene-vinyl acetate copolymer resins; and polyvinyl acetal resins such as polyvinyl acetoacetal resins and polyvinyl butyral resins. Polyester resins, polyurethane resins, and acrylic resins are particularly preferred as the adhesive component because of their high level of adhesion. The adhesive component is preferably added in an amount of 1 to 30% by weight based on the solid content of the whole adhesive layer. When the amount of the adhesive component added is below the lower limit of the above defined range, the adhesion is unsatisfactory. On the other hand, when the amount of the adhesive component added is above the upper limit of the above defined range, the effect of improving the sensitivity in transfer of dye from the dye layer cannot satisfactorily attained by the polyvinylpyrrolidone.

The adhesive layer may be formed by adding the above polyvinylpyrrolidone, optional adhesive component, and other additives, dissolving or dispersing the mixture in an organic solvent or an aqueous solvent to prepare a coating liquid, and coating the coating liquid by conventional coating means such as gravure printing, screen printing, or reverse roll coating using a gravure plate.

When the organic solvent is used in the coating liquid, the polyvinylpyrrolidone and the adhesive component used should be easily soluble in the organic solvent. On the other hand, when the aqueous solvent is used in the coating liquid, the polyvinylpyrrolidone and the adhesive component each should be a water-soluble or aqueous emulsion-type resin.

The coverage of the adhesive layer is about 0.01 to 5.0 $g/m^2$ on a dry basis.

(Dye Layer)

The thermal transfer sheet according to the present invention comprises a substrate, a heat-resistant slip layer provided on one side of the substrate, and a dye layer 23 provided through an adhesive layer on the other side of the substrate. The dye layer may be formed of a single layer of one color. Alternatively, a plurality of dye layers different from each other in hue of the dye contained therein are repeatedly provided in a face serial manner on the same plane in an identical substrate.

The dye layer is a layer formed of a thermally transferable dye held by any binder. Dyes usable herein are dyes which, upon heating, are melted, diffused, or sublimation transferred. Any dye used in the conventional thermal transfer sheet for thermal dye sublimation transfer can be used in the present invention. The dye used, however, is selected by taking into consideration, for example, hue, sensitivity in printing, lightfastness, storage stability, and solubility in the binder.

Examples of dyes include: diarylmethane dyes; triarylmethane dyes; thiazole dyes; methine dyes such as merocyanine and pyrazolonemethine dyes; azomethine dyes typified by indoaniline, acetophenoneazomethine, pyrazoloazomethine, imidazoleazomethine, imidazoazomethine, and pyridoneazomethine dyes; xanthene dyes; oxazine dyes; cyanomethylene dyes typified by dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; spiropyran dyes; indolinospiropyran dyes; fluoran dyes; rhodaminelactam dyes; naphthoquinone dyes; anthraquinone dyes; and quinophthalone dyes.

The binder for the dye layer may be any conventional resin binder. Examples of preferred binders include: cellulosic resins such as ethylcellulose, hydroxyethylcellulose, ethylhydroxycellulose, hydroxypropylcellulose, methylcellulose, cellulose acetate, and cellulose butyrate; vinyl resins such as polyvinyl alcohol, polyvinyl acetate, polyvinyl butyral, polyvinyl acetal, polyvinylpyrrolidone, and polyacrylamide; polyester resins; and phenoxy resins. Among them, cellulosic resins, acetal resins, butyral resins, polyester resins, phenoxy resins and the like are particularly preferred, for example, from the viewpoints of heat resistance and transferability of dye.

Further, in the present invention, instead of the resin binder, the following releasable graft copolymers may be used as a release agent or a binder. The releasable graft copolymers are such that at least one releasable segment selected from a polysiloxane segment, a carbon fluoride segment, a hydrocarbon fluoride segment, and a long-chain alkyl segment has been graft polymerized to the main chain of a polymer. Among them, a graft copolymer produced by grafting a polysiloxane segment onto the main chain of a polyvinyl acetal resin is particularly preferred.

The dye layer may comprise the above dye, the binder, and optionally various additives commonly used in the prior art. For example, organic fine particles, such as polyethylene wax, inorganic fine particles, phosphoric ester surfactants, and fluoro compounds may be mentioned as additives for improving the separability of the thermal transfer sheet from the image-receiving sheet and the coatability of the ink. In general, the dye layer may be formed by adding the dye, the binder, and optional additives to a suitable solvent to dissolve or disperse the ingredients, coating the resultant coating liquid onto a substrate, and drying the coating. Conventional coating means, such as gravure printing, screen printing, and reverse roll coating using a gravure plate, may be used for the coating. The coverage of the dye layer is about 0.2 to 6.0 g/m$^2$, preferably about 0.3 to 3.0 g/m$^2$ on a dry basis.

(Heat-Resistant Slip Layer)

In the thermal transfer sheet according to the present invention, a heat-resistant slip layer 24 is provided on one side of a substrate to prevent adverse effects such as heat sticking of the substrate to a thermal head and cockling at the time of printing. Any conventional resin may be used as the resin for forming the heat-resistant slip layer, and examples thereof include polyvinyl butyral resins, polyvinyl acetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, prepolymers of urethane or epoxy, nitrocellulose resins, cellulose nitrate resins, cellulose acetopropionate resins, cellulose acetate butyrate resins, cellulose acetate hydrodiene phthalate resins, cellulose acetate resins, aromatic polyamide resins, polyimide resins, polyamide-imide resins, polycarbonate resins, and chlorinated polyolefin resins.

Slipperiness-imparting agents added to or topcoated on the heat-resistant slip layer formed of the above resin include phosphoric esters, silicone oils, graphite powder, silicone graft polymers, fluoro graft polymers, acrylsilicone graft polymers, acrylsiloxanes, arylsiloxanes, and other silicone polymers. Preferred is a layer formed of a polyol, for example, a high-molecular polyalcohol compound, a polyisocyanate compound and a phosphoric ester compound. Further, the addition of a filler is more preferred.

The heat-resistant slip layer may be formed by dissolving or dispersing the resin, the slipperiness-imparting agent, and a filler in a suitable solvent to prepare a coating liquid for a heat-resistant slip layer, coating the coating liquid onto a substrate sheet by forming means, such as gravure printing, screen printing, or reverse roll coating using a gravure plate, and drying the coating. The coverage of the heat-resistant slip layer is preferably 0.1 to 3.0 g/m$^2$ on a solid basis.

EXAMPLES

The following examples further illustrate the present invention. In the following description, "parts" or "%" is by weight unless otherwise specified.

Example A1

A coating liquid having the following composition for a primer layer for a heat-resistant slip layer was coated onto a 6 $\mu$m-thick untreated polyethylene terephthalate (PET) film (DIAFOIL K 880, manufactured by Mitsubishi Polyester Film Co., Ltd.) at a coverage of 0.2 g/m$^2$ on a dry basis, and the coating was dried to form a primer layer. A coating liquid A having the following composition for a heat-resistant slip layer was coated on the surface of the primer layer at a coverage of 1.0 g/m$^2$ on a dry basis, and the coating was dried and was then heat treated at 60° C. for 5 days to form a heat-resistant slip layer.

| | |
|---|---|
| <Composition of coating liquid for primer layer for heat-resistant slip layer> | |
| Polyester resin (Nichigo Polyester LP-035, manufactured by Nippon Synthetic Chemical Industry Co., Ltd.) | 10.0 parts |
| Methyl ethyl ketone | 90.0 parts |
| <Composition of coating liquid A for heat-resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 S, manufactured by Dai-Ichi Kogyo Seiyaku Co., Ltd.) | 0.8 part |
| Methyl ethyl ketone | 42.5 parts |
| Toluene | 42.5 parts |

Figure 4:
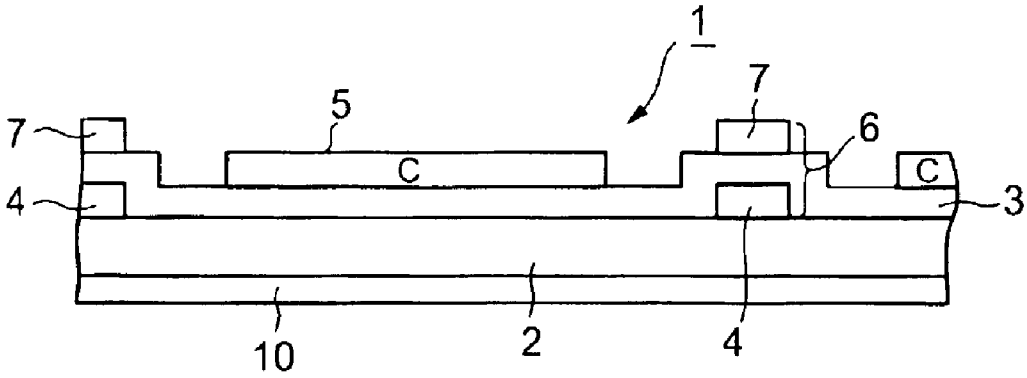
FIG. 4 is a schematic cross-sectional view showing an embodiment of the thermal transfer sheet according to the first invention.

Next, a coating liquid A having the following composition for a protective layer was coated on the surface of the substrate remote from the heat-resistant slip layer at positions as shown in FIG. 4 at a coverage of 1.0 g/m$^2$ on a dry basis, and the coating was dried to form a protective layer. Further, a coating liquid A having the following composition for an easy-adhesion layer was coated at a coverage of 0.2 g/m$^2$ on a dry basis on the whole surface of the protective layer and on the whole surface of the substrate in its portions where the protective layer was not formed. The coating was then dried to form an easy-adhesion layer.

Thereafter, a coating liquid A having the following composition for a dye layer was coated at a coverage of 0.8 g/m$^2$ on a dry basis on the easy-adhesion layer in its positions as shown in FIG. 4, and the coating was dried to form a dye layer. Further, a coating liquid having the following composition for an adhesive layer was coated at a coverage of 1.5 g/m$^2$ on a dry basis on the easy-adhesion layer in its region where the protective layer is located on the underside of the easy-adhesion layer. The coating was then dried to form an adhesive layer. Thus, a thermal transfer sheet of Example A1 was prepared.

| | |
|---|---|
| <Composition of coating liquid A for protective layer> | |
| Acrylic resin (Dianal BR-83, manufactured by Mitsubishi Rayon Co., Ltd.) | 50 parts |
| Methyl ethyl ketone | 25 parts |
| Toluene | 25 parts |
| <Composition of coating liquid A for easy-adhesion layer> | |
| Polyester resin (Vylon 240, manufactured by Toyobo Co., Ltd.) | 4.4 parts |
| Methyl ethyl ketone | 45 parts |
| Toluene | 45 parts |

-continued

| <Composition of coating liquid A for dye layer> | |
|---|---|
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |
| <Composition of coating liquid for adhesive layer> | |
| Polyester resin (Vylon 700, manufactured by Toyobo Co., Ltd.) | 69.6 parts |
| Acryl copolymer with reactive ultraviolet absorber reactively bonded thereto (UVA 635 L, manufactured by BASF Japan Ltd.) | 17.4 parts |
| Silica (SYLYSIA 310, manufactured by Fuji Silysia Chemical Ltd.) | 25 parts |

Example A2

A thermal transfer sheet of Example A2 was prepared in the same manner as in Example A1, except that a coating liquid B having the following composition for an easy-adhesion layer was used instead of the coating liquid A for an easy-adhesion layer in Example A1.

| <Composition of coating liquid B for easy-adhesion layer> | |
|---|---|
| Polyurethane resin (SUPERFLEX 460 S, manufactured by Dai-Ichi Kogyo Seiyaku Co., Ltd.) | 6 parts |
| Water | 47 parts |
| Isopropyl alcohol | 47 parts |

Example A3

A thermal transfer sheet of Example A3 was prepared in the same manner as in Example A1, except that a coating liquid C having the following composition for an easy-adhesion layer was used instead of the coating liquid A for an easy-adhesion layer in Example A1.

| <Composition of coating liquid C for easy-adhesion layer> | |
|---|---|
| Polyurethane resin (Nippollan 5120, manufactured by Nippon Polyurethane Industry Co., Ltd.) | 15 parts |
| Coronate HX | 1.2 parts |
| Methyl ethyl ketone | 41.9 parts |
| Toluene | 41.9 parts |

Example A4

A thermal transfer sheet of Example A4 was prepared in the same manner as in Example A1, except that the coverage on a dry basis of the coating liquid A for an easy-adhesion layer in Example A1 was changed to 0.1 g/m$^2$.

Example A5

A thermal transfer sheet of Example A5 was prepared in the same manner as in Example A1, except that the coverage on a dry basis of the coating liquid A for an easy-adhesion layer in Example A1 was changed to 0.4 g/m$^2$.

Example A6

A thermal transfer sheet of Example A6 was prepared in the same manner as in Example A1, except that a coating liquid B having the following composition for a heat-resistant slip layer was used instead of the coating liquid A for a heat-resistant slip layer in Example A1.

| <Composition of coating liquid B for heat-resistant slip layer> | |
|---|---|
| Polyamide-imide resin (HR-15 ET, manufactured by Toyobo Co., Ltd.) | 4.4 parts |
| Polyamide-imide silicone resin (HR-14 ET, manufactured by Toyobo Co., Ltd.) | 4.4 parts |
| Zinc stearyl phosphate (LBT 1830, manufactured by Sakai Chemical Co., Ltd.) | 0.9 part |
| Polyester resin (Vylon 220, manufactured by Toyobo Co., Ltd.) | 0.3 part |
| Toluene | 45 parts |
| Ethanol | 45 parts |

Example A7

A thermal transfer sheet of Example A7 was prepared in the same manner as in Example A2, except that the coating liquid B for a heat-resistant slip layer was used instead of the coating liquid A for a heat-resistant slip layer in Example A2.

Example A8

A thermal transfer sheet of Example A8 was prepared in the same manner as in Example A3, except that the coating liquid B for a heat-resistant slip layer was used instead of the coating liquid A for a heat-resistant slip layer in Example A3.

Example A9

A thermal transfer sheet of Example A9 was prepared in the same manner as in Example A1, except that a coating liquid B having the following composition for a dye layer was used instead of the coating liquid A for a dye layer in Example A1.

| <Composition of coating liquid B for dye layer> | |
|---|---|
| Kayaset Blue 714 | 5.5 parts |
| Polyvinyl acetal resin (S-lec KS-5, manufactured by Sekisui Chemical Co., Ltd.) | 3.0 parts |
| Methyl ethyl ketone | 45.5 parts |
| Toluene | 45.5 parts |

Example A10

A thermal transfer sheet of Example A10 was prepared in the same manner as in Example A2, except that the coating liquid B for a dye layer was used instead of the coating liquid A for a dye layer in Example A2.

Example A11

A thermal transfer sheet of Example A11 was prepared in the same manner as in Example A3, except that the coating liquid B for a dye layer was used instead of the coating liquid A for a dye layer in Example A3.

Example A12

A thermal transfer sheet of Example A12 was prepared in the same manner as in Example A1, except that a coating liquid C having the following composition for a dye layer was used instead of the coating liquid A for a dye layer in Example A1.

| <Composition of coating liquid C for dye layer> | |
|---|---|
| C.I. Solvent Blue 22 | 5.5 parts |
| Phenoxy resin | 3.0 parts |
| Methyl ethyl ketone | 45.5 parts |
| Toluene | 45.5 parts |

Example A13

A thermal transfer sheet of Example A13 was prepared in the same manner as in Example A1, except that a 4.5 μm-thick untreated PET film (DIAFOIL K 880, manufactured by Mitsubishi Polyester Film Co., Ltd.) was used instead of the 6 μm-thick untreated PET film in Example A1.

Example A14

A thermal transfer sheet of Example A14 was prepared in the same manner as in Example A1, except that a 6 μm-thick untreated polyethylene naphthalate (PEN) film (Teonex, manufactured by Teijin Ltd.) was used instead of the 6 μm-thick untreated PET film in Example A1.

Example A15

A thermal transfer sheet of Example A15 was prepared in the same manner as in Example A1, except that a 6 μm-thick untreated polyphenylene sulfide (PPS) film (Torelina, manufactured by Toray Industries, Inc.) was used instead of the 6 μm-thick untreated PET film in Example A1.

Example A16

A thermal transfer sheet of Example A16 was prepared in the same manner as in Example A1, except that a coating liquid D having the following composition for an easy-adhesion layer was used instead of the coating liquid A for an easy-adhesion layer in Example A1.

| <Composition of coating liquid D for easy-adhesion layer> | |
|---|---|
| Polyvinylpyrrolidone resin (K-90, manufactured by ISP K.K.) | 10 parts |
| Methyl ethyl ketone | 45 parts |
| Isopropyl alcohol | 45 parts |

Example A17

A thermal transfer sheet of Example A17 was prepared in the same manner as in Example A1, except that a coating liquid E having the following composition for an easy-adhesion layer was used instead of the coating liquid A for an easy-adhesion layer in Example A1.

| <Composition of coating liquid E for easy-adhesion layer> | |
|---|---|
| Polyvinylpyrrolidone resin (K-90, manufactured by ISP K.K.) | 10 parts |
| Silica sol (30% isopropyl alcohol dispersion, manufactured by Nissan Chemical Industries Ltd.) | 10 parts |
| Methyl ethyl ketone | 45 parts |
| Isopropyl alcohol | 45 parts |

Example A18

A thermal transfer sheet of Example A18 was prepared in the same manner as in Example A1, except that a coating liquid F having the following composition for an easy-adhesion layer was used instead of the coating liquid A for an easy-adhesion layer in Example A1.

| <Composition of coating liquid F for easy-adhesion layer> | |
|---|---|
| Polyvinylpyrrolidone resin (K-90, manufactured by ISP K.K.) | 10 parts |
| Silica sol (30% isopropyl alcohol dispersion, manufactured by Nissan Chemical Industries Ltd.) | 10 parts |
| Benzotriazole ultraviolet absorber (TINUVIN 900, manufactured by CIBA-GEIGY Ltd.) | 1 part |
| Methyl ethyl ketone | 45 parts |
| Isopropyl alcohol | 45 parts |

Example A19

A thermal transfer sheet of Example A19 was prepared in the same manner as in Example A1, except that a coating liquid G having the following composition for an easy-adhesion layer was used instead of the coating liquid A for an easy-adhesion layer in Example A1.

| <Composition of coating liquid G for easy-adhesion layer> | |
|---|---|
| Vinylpyrrolidone-vinyl acetate copolymer | 10 parts |
| Methyl ethyl ketone | 45 parts |
| Isopropyl alcohol | 45 parts |

Example A20

A thermal transfer sheet of Example A20 was prepared in the same manner as in Example A1, except that a coating liquid H having the following composition for an easy-adhesion layer was used instead of the coating liquid A for an easy-adhesion layer in Example A1.

| <Composition of coating liquid H for easy-adhesion layer> | |
|---|---|
| Polyvinylpyrrolidone resin (K-90, manufactured by ISP K.K.) | 10 parts |
| Polyester resin (Vylon 220, manufactured by Toyobo Co., Ltd.) | 1 part |
| Methyl ethyl ketone | 45 parts |
| Isopropyl alcohol | 45 parts |

Comparative Example A1

A thermal transfer sheet of Comparative Example A1 was prepared in the same manner as in Example A1, except that the coating liquid A for an easy-adhesion layer was not coated onto the 6 μm-thick untreated polyethylene terephthalate (PET) film.

Comparative Example A2

A thermal transfer sheet of Comparative Example A2 was prepared in the same manner as in Example A1, except that a 6 μm-thick polyethylene terephthalate (PET) film (DIAFOIL K 203 E, manufactured by Mitsubishi Polyester Film Co., Ltd.) subjected to easy-adhesion treatment was used and the coating liquid A for an easy-adhesion layer was not coated.

Comparative Example A3

A thermal transfer sheet of Comparative Example A3 was prepared in the same manner as in Example A1, except that a 6 μm-thick polyethylene terephthalate (PET) film subjected to corona discharge treatment was used and the coating liquid A for an easy-adhesion layer was not coated.

Comparative Example A4

A thermal transfer sheet of Comparative Example A4 was prepared in the same manner as in Example A1, except that a 6 μm-thick polyethylene terephthalate (PET) film subjected to plasma treatment was used and the coating liquid A for an easy-adhesion layer was not coated.

Comparative Example A5

A 6 μm-thick untreated polyethylene terephthalate (PET) film as a substrate provided with a heat-resistant slip layer on one side thereof was provided. The coating liquid A for an easy-adhesion layer was coated at a coverage of 0.2 g/m$^2$ on a dry basis on the whole surface of the substrate remote from the heat-resistant slip layer, and the coating was dried to form an easy-adhesion layer. The coating liquid A for a protective layer was coated at a coverage of 1.0 g/m$^2$ on a dry basis onto the easy-adhesion layer in its positions as shown in FIG. 4, and the coating was dried to form a protective layer. Further, the coating liquid A for a dye layer was coated at a coverage of 0.8 g/m$^2$ on a dry basis onto the easy-adhesion layer in its positions as shown in FIG. 4. The coating was dried to provide a dye layer. Thus, a thermal transfer sheet of Comparative Example A5 was prepared.

Comparative Example A6

A 6 μm-thick polyethylene terephthalate (PET) film (DIAFOIL K 203 E, manufactured by Mitsubishi Polyester Film Co., Ltd.) subjected to easy-adhesion treatment was provided. The coating liquid for a primer layer for a heat-resistant slip layer used in Example A1 was coated onto the PET film at a coverage of 0.2 g/m$^2$ on a dry basis, and the coating was dried to form a primer layer. The coating liquid A for a heat-resistant slip layer used in Example A1 was coated on the surface of the primer layer at a coverage of 1.0 g/m$^2$ on a dry basis, and the coating was dried and was then heat treated at 60° C. for 5 days to form a heat-resistant slip layer 10.

Figure 5:
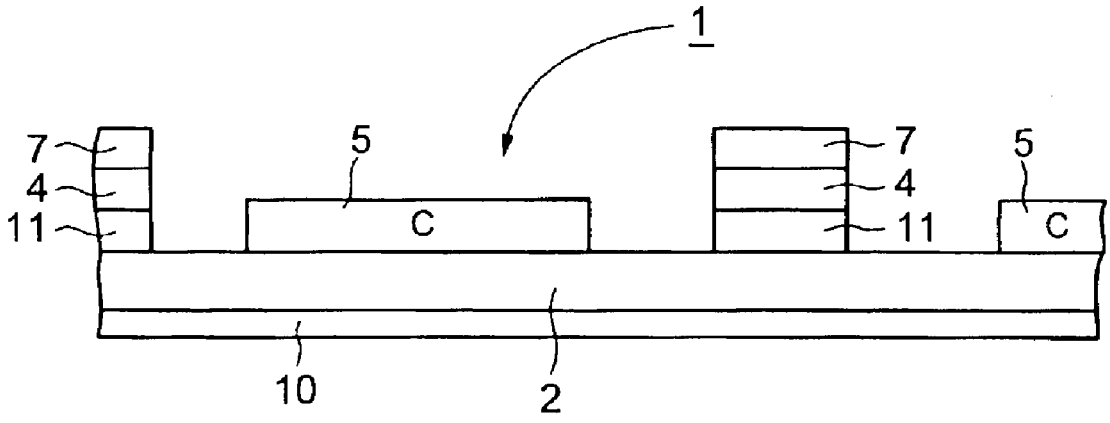
FIG. 5 is a schematic cross-sectional view showing an example of the conventional thermal transfer sheet.

Next, the coating liquid A for a dye layer was coated at a coverage of 0.8 g/m$^2$ on a dry basis onto the surface of the PET film, remote from the heat-resistant slip layer 10, that is, onto the easy-adhesion treated surface, at its positions as shown in FIG. 5, and the coating was dried to form a dye layer 15. A coating liquid having the following composition for a release layer was then coated at a coverage of 0.8 g/m$^2$ on a dry basis onto the PET film in its positions as shown in FIG. 5, and the coating was dried to form a release layer 11. Further, the coating liquid A for a protective layer was coated onto the release layer 11 at a coverage of 1.0 g/m$^2$ on a dry basis, and the coating was dried to form a protective layer 4. The coating liquid for an adhesive layer used in Example A1 was then coated onto the protective layer 4 at a coverage of 1.5 g/m$^2$ on a dry basis, and the coating was dried to form an adhesive layer 7. Thus, a thermal transfer sheet of Comparative Example A6 was prepared.

| <Composition of coating liquid for release layer> | |
|---|---|
| Silicone-modified acrylic resin (CELTOP 226, manufactured by Daicel Chemical Industries, Ltd.) | 45.7 parts |
| Aluminum catalyst (CELTOP CAT-A, manufactured by Daicel Chemical Industries, Ltd.) | 8.5 parts |
| Methyl ethyl ketone | 22.9 parts |
| Toluene | 22.9 parts |

Printing was carried out under the following conditions.

Printing machine: Digital color printer P-200, manufactured by Olympus Optical Co., LTD.

Printing paper: Specialty standard set of printing papers for digital color printer P-200

Thermal transfer sheet: Thermal transfer sheets prepared in Examples A1 to A20 and Comparative Examples A1 to A6

Printing pattern: Gradation pattern

Further, the protective layer was transferred from the thermal transfer sheet prepared in each example with the same printer as used in the formation of the image so as to cover the printed portion in the print. At that time, the prints were evaluated for dye transferability (abnormal transfer, uneven transfer, etc.) and for transferability of the protective layer (abnormal transfer, sticking, etc.). Further, the glossiness of the image portion provided with the protective layer transferred onto the print was measured.

For the thermal transfer sheet in each example, in such a state that the primer layer and the heat-resistant slip layer were provided on the backside and neither the protective layer nor the dye layer was provided on the opposite side thereof, the sheet was stored in the form of a roll having a winding length of 240 m under an environment of 50° C. and 85% RH for 2 days, and the roll was then rewound to investigate the sheet for blocking.

Further, the prints with the protective layer transferred thereonto were evaluated for plasticizer resistance and scratch resistance.

(Blocking Resistance)

The sheet was visually inspected for blocking, and the results were evaluated according to the following criteria.

○: There was no layer transfer onto the contacted face, and the sheet could be smoothly rewound.

X: There was layer transfer onto the contacted face, or otherwise the sheet could not be smoothly rewound due to sticking.

(Dye Transferability)

Dye transferability onto the print (abnormal transfer, uneven transfer, etc.) was visually inspected, and the results were evaluated according to the following criteria.

○: Unfavorable phenomena such as abnormal transfer and uneven transfer did not take place, and, thus, the dye transferability was good.

X: Abnormal transfer or uneven transfer took place, and, thus, the dye transferability was poor.

(Transferability of Protective Layer)

The prints were visually inspected for the transferability of the protective layer, that is, for abnormal transfer of the protective layer, sticking, etc., and the results were evaluated according to the following criteria.

◎: Neither abnormal transfer nor sticking took place, and the protective layer could be transferred by an energy on a level which was at least 0.05 mJ/line lower than the energy required in the prior art technique.

○: Neither abnormal transfer nor sticking took place.

Δ: Partial abnormal transfer or sticking took place, or otherwise the separated interface was not smooth although abnormal transfer did not take place.

X: Abnormal transfer or sticking took place, and the protective layer could not be transferred.

(Glossiness)

In the maximum density portion in the print provided with the protective layer prepared in each example, the specular glossiness (GS (45-degree)) of the surface of the protective layer was measured with GlossMeter VG 2000, manufactured by Nippon Denshoku Co., Ltd. according to JIS Z 8741-1983. The glossiness was evaluated according to the following criteria.

◎: The glossiness was more than 110% relative to the glossiness in Comparative Example A6.

○: The glossiness was in the range of 100 to 110% relative to the glossiness in Comparative Example A6.

X: The glossiness was less than 100% relative to the glossiness in Comparative Example A6.

≃: The glossiness was immeasurable because the protective layer was not normally transferred.

For Comparative Examples A1, A3, and A4 in which the dye could not be normally transferred, the glossiness was measured after the transfer of the protective layer in each of the comparative example onto the dye transferred object in Comparative Example A6.

(Plasticizer Resistance)

A soft vinyl chloride sheet (Arutoron) was put on top of the print in its image formed face, and a load of 40 g/m$^2$ was applied thereon. In this state, the assembly was allowed to stand at 50° C. for 48 hr. Thereafter, the vinyl chloride sheet was separated from the print, and the vinyl chloride sheet was visually inspected for the transfer of the dye in the print onto the vinyl chloride sheet. The level of dye transferred onto the vinyl chloride sheet was evaluated according to the following criteria.

◎: The dye was not transferred at all.

○: The dye was hardly transferred.

Δ: The dye was transferred to some extent.

X: The dye was transferred onto substantially the whole area of the vinyl chloride sheet.

(Scratch Resistance)

The print was subjected to a 200-revolution abrasion test with a scratch resistance tester (Shimadzu Dynamic Ultra Micro Hardness Tester DHU-201 S). In this case, the state of the image in the print was visually inspected, and the results were evaluated according to the following criteria.

◎: The image was not influenced by the abrasion at all.

○: The image was influenced, by the abrasion, on a very small level which was hardly conspicuous.

Δ: The image was somewhat abraded.

X: The image was abraded to a considerable extent.

The results of the above evaluations and the results of the measurements are shown in Tables A1 and A2.

TABLE A1

| | Blocking | Dye transferability | Protective layer transferability | Glossiness | Plasticizer resistance | Scratch resistance |
|---|---|---|---|---|---|---|
| Ex. A1 | ○ | ○ | ○ | ◎ | ○ | ○ |
| Ex. A2 | ○ | ○ | ○ | ◎ | ○ | ○ |
| Ex. A3 | ○ | ○ | ○ | ◎ | ○ | ○ |
| Ex. A4 | ○ | ○ | ○ | ◎ | ○ | ○ |
| Ex. A5 | ○ | ○ | ○ | ◎ | ○ | ○ |
| Ex. A6 | ○ | ○ | ○ | ◎ | ○ | ○ |
| Ex. A7 | ○ | ○ | ○ | ◎ | ○ | ○ |
| Ex. A8 | ○ | ○ | ○ | ◎ | ○ | ○ |
| Ex. A9 | ○ | ○ | ○ | ◎ | ○ | ○ |
| Ex. A10 | ○ | ○ | ○ | ◎ | ○ | ○ |
| Ex. A11 | ○ | ○ | ○ | ◎ | ○ | ○ |
| Ex. A12 | ○ | ○ | ○ | ○ | ○ | ○ |
| Ex. A13 | ○ | ○ | ○ | ◎ | ○ | ○ |
| Ex. A14 | ○ | ○ | ○ | ◎ | ○ | ○ |
| Ex. A15 | ○ | ○ | ○ | ◎ | ○ | ○ |
| Ex. A16 | ○ | ○ | ◎ | ◎ | ◎ | ◎ |
| Ex. A17 | ○ | ○ | ◎ | ◎ | ◎ | ◎ |
| Ex. A18 | ○ | ○ | ◎ | ◎ | ◎ | ◎ |
| Ex. A19 | ○ | ○ | ◎ | ◎ | ◎ | ◎ |
| Ex. A20 | ○ | ○ | ◎ | ◎ | ◎ | ◎ |

TABLE A2

| | Blocking | Dye transferability | Protective layer transferability | Glossiness | Plasticizer resistance | Scratch resistance |
|---|---|---|---|---|---|---|
| Comp. Ex. A1 | ○ | X | ○ | ○ | ○ | ○ |
| Comp. Ex. A2 | X | ○ | X | ○ | ○ | ○ |

TABLE A2-continued

| | Blocking | Dye transferability | Protective layer transferability | Glossi-ness | Plasticizer resistance | Scratch resistance |
|---|---|---|---|---|---|---|
| Comp. Ex. A3 | ○ | X | Δ | X | ○ | ○ |
| Comp. Ex. A4 | ○ | X | Δ | X | ○ | ○ |
| Comp. Ex. A5 | ○ | ○ | X | ○ | ○ | ○ |
| Comp. Ex. A6 | X | ○ | ○ | ○ | ○ | ○ |

As described above, in the thermal transfer sheet according to the present invention, dye layers of at least one color and a thermally transferable protective layer are provided in a face serial manner on one side of a substrate. A protective layer is provided on a part of one side of the substrate. Thereafter, an easy-adhesion layer is provided on the whole surface of the protective layer and the substrate. Next, the dye layers are provided on the easy-adhesion layer in its region where the protective layer is not located on the underside of the easy-adhesion layer. Preferably, an adhesive layer is provided on the easy-adhesion layer in its region where the protective layer is located on the underside of the easy-adhesion layer.

Preferably, a detection mark is provided between the dye layer and the thermally transferable protective layer and/or between the dye layers of a plurality of colors.

This thermal transfer sheet can eliminate the need to provide a very expensive substrate subjected to easy-adhesion treatment in the production thereof. Specifically, the cost can be reduced by providing a plain substrate and then coating an easy-adhesion layer.

Further, for example, a substrate, which cannot be subjected to easy-adhesion treatment without difficulties, and a substrate, for which any easy-adhesion treated grade is not available, may be used. Therefore, various substrates may be utilized according to applications, and the range of usable substrates can be broadened.

Further, since the provision of a release layer is unnecessary, damage to the substrate by heat applied at the time of drying can be reduced and, at the same time, a reduction in thickness of the thermal transfer sheet can be realized.

In the conventional thermal transfer sheet for a protective layer, since separation occurs at the interface of gravure coated protective layer and release layer, the smoothness of the interface is poor. By contrast, according to the present invention, the separation occurs directly from the surface of the substrate. Therefore, an improvement in surface smoothness as in the case of ferro treatment can be realized, and, by virtue of this, an increase in glossiness of the print with the protective layer transferred thereon can be realized.

In the prior art technique, the use of an easy-adhesion treated film sometimes causes blocking upon winding after coating the backside layer. On the other hand, in the present invention, when the backside layer is coated, the opposite side is in the untreated state. Therefore, blocking can be prevented.

Example B1

A 6 μm-thick polyethylene terephthalate (PET) film (DIAFOIL K 203 E, manufactured by Mitsubishi Polyester Film Co., Ltd.) subjected to easy-adhesion treatment was provided as a substrate. A coating liquid A having the following composition for an adhesive layer was gravure coated onto the easy-adhesion treated face in the PET film at a coverage of 0.2 g/m$^2$ on a dry basis, and the coating was dried to form an adhesive layer. A coating liquid ① having the following composition for a dye layer was then gravure coated on the adhesive layer at a coverage of 0.8 g/m$^2$ on a dry basis, and the coating was dried to form a dye layer. Thus, a thermal transfer sheet of Example B1 was prepared. In this case, a coating liquid a having the following composition for a heat-resistant slip layer was previously gravure coated on the other side of the substrate at a coverage of 1.0 g/m$^2$ on a dry basis, and the coating was dried to form a heat-resistant slip layer.

| | |
|---|---|
| <Composition of coating liquid A for adhesive layer> | |
| Polyvinylpyrrolidone resin (K-90, manufactured by ISP K.K.) | 6 parts |
| Methyl ethyl ketone | 47 parts |
| Isopropyl alcohol | 47 parts |
| <Composition of coating liquid ① for dye layer> | |
| C.I. Solvent Blue 22 | 5.5 parts |
| Polyvinyl acetal resin (S-lec KS-5, manufactured by Sekisui Chemical Co., Ltd.) | 3.0 parts |
| Methyl ethyl ketone | 22.5 parts |
| Toluene | 68.2 parts |
| <Composition of coating liquid a for heat-resistant slip layer> | |
| Polyvinyl butyral resin (S-lec BX-1, manufactured by Sekisui Chemical Co., Ltd.) | 13.6 parts |
| Polyisocyanate curing agent (Takenate D 218, manufactured by Takeda Chemical Industries, Ltd.) | 0.6 part |
| Phosphoric ester (Plysurf A 208 5, manufactured by Dai-Ichi Kogyo Seiyaku Co., Ltd.) | 0.8 part |
| Methyl ethyl ketone | 42.5 parts |
| Toluene | 42.5 parts |

Example B2

The same easy-adhesion treated PET film substrate as used in Example B1 was provided. A heat-resistant slip layer as described in Example B1 was previously formed on the other side of the substrate. A coating liquid A for an adhesive layer as used in Example B1 was gravure coated onto the easy-adhesion treated face in the substrate at a coverage of 0.03 g/m$^2$ on a dry basis, and the coating was dried to form an adhesive layer. A dye layer was formed on the adhesive layer in the same manner as in Example B1. Thus, a thermal transfer sheet of Example B2 was prepared.

Example B3

The same easy-adhesion treated PET film substrate as used in Example B1 was provided. A heat-resistant slip layer as described in Example B1 was previously formed on the other side of the substrate. A coating liquid A for an adhesive layer as used in Example B1 was gravure coated onto the easy-adhesion treated face in the substrate at a coverage of 0.7 g/m$^2$ on a dry basis, and the coating was dried to form an adhesive layer. A dye layer was formed on the adhesive layer in the same manner as in Example B1. Thus, a thermal transfer sheet of Example B3 was prepared.

Example B4

The same easy-adhesion treated PET film substrate as used in Example B1 was provided. A heat-resistant slip layer as described in Example B1 was previously formed on the other side of the substrate. A coating liquid A for an adhesive layer as used in Example B1 was gravure coated onto the easy-adhesion treated face in the substrate at a coverage of 0.2 g/m$^2$ on a dry basis, and the coating was dried to form an adhesive layer. A coating liquid ② having the following composition for a dye layer was gravure coated on the adhesive layer at a coverage of 0.8 g/m$^2$ on a dry basis, and the coating was dried to form a dye layer to prepare a thermal transfer sheet of Example B4.

| <Composition of coating liquid ② for dye layer> | |
|---|---|
| C.I. Solvent Blue 22 | 6.0 parts |
| Phenoxy resin (PKHH, manufactured by Union Carbide) | 3.0 parts |
| Methyl ethyl ketone | 45.5 parts |
| Toluene | 45.5 parts |

Example B5

The same easy-adhesion treated PET film substrate as used in Example B1 was provided. A heat-resistant slip layer as described in Example B1 was previously formed on the other side of the substrate. A coating liquid A for an adhesive layer as used in Example B1 was gravure coated onto the easy-adhesion treated face in the substrate at a coverage of 0.2 g/m$^2$ on a dry basis, and the coating was dried to form an adhesive layer. A coating liquid ③ having the following composition for a dye layer was gravure coated on the adhesive layer at a coverage of 0.8 g/m$^2$ on a dry basis, and the coating was dried to form a dye layer to prepare a thermal transfer sheet of Example B5.

| <Composition of coating liquid ③ for dye layer> | |
|---|---|
| C.I. Solvent Blue 22 | 6.0 parts |
| Cellulose acetate butyrate (CAB 381-20, manufactured by Eastman Chemical Co.) | 3.0 parts |
| Methyl ethyl ketone | 45.5 parts |
| Toluene | 45.5 parts |

Example B6

The same easy-adhesion treated PET film substrate as used in Example B1 was provided. A heat-resistant slip layer as described in Example B1 was previously formed on the other side of the substrate. A coating liquid A for an adhesive layer as used in Example B1 was gravure coated onto the easy-adhesion treated face in the substrate at a coverage of 0.2 g/m$^2$ on a dry basis, and the coating was dried to form an adhesive layer. A coating liquid ④ having the following composition for a dye layer was gravure coated on the adhesive layer at a coverage of 0.8 g/m$^2$ on a dry basis, and the coating was dried to form a dye layer to prepare a thermal transfer sheet of Example B6.

| <Composition of coating liquid ④for dye layer | |
|---|---|
| Dye C-1 (represented by the following structural formula) | 2.5 parts |
| Polyvinyl acetal resin (S-1ec KS-5, manufactured by Sekisui Chemical Co., Ltd.) | 3.5 parts |
| Methyl ethyl ketone | 47 parts |
| Toluene | 47 parts |

C-1

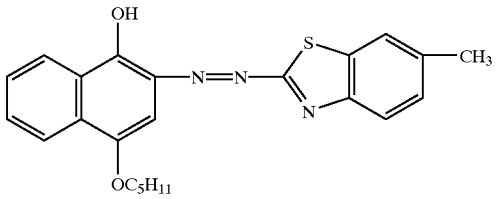

Example B7

The same easy-adhesion treated PET film substrate as used in Example B1 was provided. A heat-resistant slip layer as described in Example B1 was previously formed on the other side of the substrate. A coating liquid B having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B7 was prepared.

| <Composition of coating liquid B for adhesive layer> | |
|---|---|
| Polyvinylpyrrolidone resin (K-90, manufactured by ISP K.K.) | 6 parts |
| Water | 47 parts |
| Isopropyl alcohol | 47 parts |

Example B8

The same easy-adhesion treated PET film substrate as used in Example B1 was provided. A heat-resistant slip layer as described in Example B1 was previously formed on the other side of the substrate. A coating liquid C having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B8 was prepared.

| <Composition of coating liquid C for adhesive layer> | |
|---|---|
| Polyvinylpyrrolidone resin (K-120, manufactured by Isp K.K.) | 6 parts |
| Water | 47 parts |
| Isopropyl alcohol | 47 parts |

Example B9

The same easy-adhesion treated PET film substrate as used in Example B1 was provided. A heat-resistant slip layer as described in Example B1 was previously formed on the other side of the substrate. A coating liquid D having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B9 was prepared.

| <Composition of coating liquid D for adhesive layer> | |
|---|---|
| Polyvinylpyrrolidone resin (K-60, solid content 45%, manufactured by ISP K.K.) | 13.3 parts |
| Water | 47 parts |
| Isopropyl alcohol | 47 parts |

Example B10

The same easy-adhesion treated PET film substrate as used in Example B1 was provided. A heat-resistant slip layer as described in Example B1 was previously formed on the other side of the substrate. A coating liquid E having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B10 was prepared.

| <Composition of coating liquid E for adhesive layer> | |
|---|---|
| Polyvinylpyrrolidone resin (K-90, manufactured by ISP K.K.) | 5.7 parts |
| Polyester resin (RV 220, manufactured by Toyobo Co., Ltd.) | 0.3 part |
| Methyl ethyl ketone | 47 parts |
| Isopropyl alcohol | 30 parts |
| Toluene | 17 parts |

Example B11

The same easy-adhesion treated PET film substrate as used in Example B1 was provided. A heat-resistant slip layer as described in Example B1 was previously formed on the other side of the substrate. A coating liquid F having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B11 was prepared.

| <Composition of coating liquid F for adhesive layer> | |
|---|---|
| Polyvinylpyrrolidone resin (K-90, manufactured by ISP K.K.) | 5.7 parts |
| Polyurethane resin (SUPERFLEX 460 S, manufactured by Dai-Ichi Kogyo Seiyaku Co., Ltd.) | 0.3 part |
| Water | 47 parts |
| Isopropyl alcohol | 47 parts |

Example B12

The same easy-adhesion treated PET film substrate as used in Example B1 was provided. A heat-resistant slip layer as described in Example B1 was previously formed on the other side of the substrate. A coating liquid G having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B12 was prepared.

| <Composition of coating liquid G for adhesive layer> | |
|---|---|
| Polyvinylpyrrolidone resin (K-90, manufactured by ISP K.K.) | 5.7 parts |
| Acrylic resin (ME-18, manufactured by Nagase ChemteX Corporation) | 0.3 part |
| Water | 47 parts |
| Isopropyl alcohol | 47 parts |

Example B13

The same easy-adhesion treated PET film substrate as used in Example B1 was provided. A heat-resistant slip layer as described in Example B1 was previously formed on the other side of the substrate. A coating liquid H having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B13 was prepared.

| <Composition of coating liquid H for adhesive layer> | |
|---|---|
| Polyvinylpyrrolidone resin (K-30, manufactured by ISP K.K.) | 3 parts |
| Water | 47 parts |
| Isopropyl alcohol | 47 parts |

Example B14

A 6 $\mu$m-thick untreated polyethylene terephthalate (PET) film (DIAFOIL K 880, manufactured by Mitsubishi Polyester Film Co., Ltd.) as a substrate was subjected to corona irradiation treatment. A coating liquid A for an adhesive layer as used in Example B1 was gravure coated at a coverage of 0.2 g/m$^2$ on a dry basis onto the substrate in its side subjected to corona irradiation treatment, and the coating was dried to form an adhesive layer. Further, a dye layer was formed on the adhesive layer in the same manner as in Example B1. Thus, a thermal transfer sheet of Example B14 was prepared. In this case, a heat-resistant slip layer was previously formed on the other side of the substrate in the same manner as in Example B1.

Example B15

The same PET film substrate subjected to corona irradiation treatment as used in Example B14 was provided. A heat-resistant slip layer as described in Example B1 was previously formed on the other side of the substrate. A coating liquid B for an adhesive layer as used in Example B7 was gravure coated at a coverage of 0.2 g/m$^2$ on a dry basis onto the substrate in its side subjected to corona irradiation treatment, and the coating was dried to form an adhesive layer. A dye layer was then formed on the adhesive layer in the same manner as in Example B1. Thus, a thermal transfer sheet of Example B15 was prepared.

Example B16

A 6 $\mu$m-thick untreated polyethylene terephthalate (PET) film (DIAFOIL K 880, manufactured by Mitsubishi Polyester Film Co., Ltd.) as a substrate was subjected to plasma irradiation treatment. A heat-resistant slip layer as described in Example B1 was previously formed on the other side of the substrate. A coating liquid A for an adhesive layer as used in Example B1 was gravure coated at a coverage of 0.2 g/m$^2$ on a dry basis onto the substrate in its side subjected to plasma irradiation treatment, and the coating was dried to form an adhesive layer. Further, a dye layer was formed on the adhesive layer in the same manner as in Example B1. Thus, a thermal transfer sheet of Example B16 was prepared.

Example B17

A 6 $\mu$m-thick untreated polyethylene terephthalate (PET) film (DIAFOIL K 880, manufactured by Mitsubishi Polyester Film Co., Ltd.) as a substrate was provided. A heat-resistant slip layer as described in Example B1 was previously formed on the other side of the substrate. A coating liquid E for an adhesive layer as used in Example B10 was gravure coated at a coverage of 0.2 g/m$^2$ on a dry basis onto the substrate in its untreated side, and the coating was dried to form an adhesive layer. Further, a dye layer was formed on the adhesive layer in the same manner as in Example B1. Thus, a thermal transfer sheet of Example B17 was prepared.

Example B18

The same untreated PET film substrate as used in Example B17 was provided. A heat-resistant slip layer as described in Example B1 was previously formed on the other side of the substrate. A coating liquid I having the following composition for an adhesive layer was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B18 was prepared.

| <Composition of coating liquid I for adhesive layer> | |
|---|---|
| Polyvinylpyrrolidone resin (K-90, manufactured by ISP K.K.) | 4.5 parts |
| Polyester resin (RV 220, manufactured by Toyobo Co., Ltd.) | 1.5 parts |
| Methyl ethyl ketone | 47 parts |
| Isopropyl alcohol | 30 parts |
| Toluene | 17 parts |

Example B19

The same untreated PET film substrate as used in Example B17 was provided. A heat-resistant slip layer as described in Example B1 was previously formed on the other side of the substrate. A coating liquid F for an adhesive layer as used in Example B11 was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B19 was prepared.

Example B20

The same untreated PET film substrate as used in Example B17 was provided. A heat-resistant slip layer as described in Example B1 was previously formed on the other side of the substrate. A coating liquid J having the following composition for an adhesive layer was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B20 was prepared.

| <Composition of coating liquid J for adhesive layer> | |
|---|---|
| Polyvinylpyrrolidone resin (K-90, manufactured by ISP K.K.) | 4.5 parts |
| Polyurethane resin (SUPERFLEX 460 S, manufactured by Dai-Ichi Kogyo Seiyaku Co., Ltd.) | 1.5 parts |
| Water | 47 parts |
| Isopropyl alcohol | 47 parts |

Example B21

The same untreated PET film substrate as used in Example B17 was provided. A heat-resistant slip layer as described in Example B1 was previously formed on the other side of the substrate. A coating liquid G for an adhesive layer as used in Example B12 was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B21 was prepared.

Example B22

The same untreated PET film substrate as used in Example B17 was provided. A heat-resistant slip layer as described in Example B1 was previously formed on the other side of the substrate. A coating liquid K having the following composition for an adhesive layer was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B22 was prepared.

| <Composition of coating liquid K for adhesive layer> | |
|---|---|
| Polyvinylpyrrolidone resin (K-90, manufactured by ISP K.K.) | 4.5 parts |
| Acrylic resin (ME-18, manufactured by Nagase ChemteX Corporation) | 1.5 parts |
| Water | 47 parts |
| Isopropyl alcohol | 47 parts |

Example B23

The same untreated PET film substrate as used in Example B17 was provided. A heat-resistant slip layer as described in Example B1 was previously formed on the other side of the substrate. A coating liquid L having the following composition for an adhesive layer was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B23 was prepared.

| <Composition of coating liquid L for adhesive layer> | |
|---|---|
| Polyvinylpyrrolidone resin (K-90, manufactured by ISP K.K.) | 3.9 parts |
| Polyester resin (RV 220, manufactured by Toyobo Co., Ltd.) | 2.1 parts |
| Methyl ethyl ketone | 47 parts |
| Isopropyl alcohol | 30 parts |
| Toluene | 17 parts |

Example B24

The same untreated PET film substrate as used in Example B17 was provided. A heat-resistant slip layer as described in Example B1 was previously formed on the other side of the substrate. A coating liquid M having the following composition for an adhesive layer was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B24 was prepared.

| <Composition of coating liquid M for adhesive layer> | |
|---|---|
| Polyvinylpyrrolidone resin (K-90, manufactured by ISP K.K.) | 3.9 parts |
| Polyurethane resin (SUPERFLEX 460 S, manufactured by Dai-Ichi Kogyo Seiyaku Co., Ltd.) | 2.1 parts |
| Water | 47 parts |
| Isopropyl alcohol | 47 parts |

Example B25

The same untreated PET film substrate as used in Example B17 was provided. A heat-resistant slip layer as described in Example B1 was previously formed on the other side of the substrate. A coating liquid N having the following composition for an adhesive layer was gravure coated onto the untreated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Example B25 was prepared.

| <Composition of coating liquid N for adhesive layer> | |
|---|---|
| Polyvinylpyrrolidone resin (K-90, manufactured by ISP K.K.) | 3.9 parts |
| Acrylic resin (ME-18, manufactured by Nagase ChemteX corporation) | 2.1 parts |
| Water | 47 parts |
| Isopropyl alcohol | 47 parts |

Example B26

The thermal transfer sheet prepared in Example B1 was provided. In the following evaluation, however, unlike Example B1, a polyvinyl chloride resin (PVC) card was used as a thermal transfer image-receiving sheet used in combination with the thermal transfer sheet.

Example B27

The thermal transfer sheet prepared in Example B14 was provided. In the following evaluation, however, unlike Example B14, a polyvinyl chloride resin (PVC) card was used as a thermal transfer image-receiving sheet used in combination with the thermal transfer sheet.

Comparative Example B1

The same easy-adhesion treated PET film substrate as used in Example B1 was provided, and a heat-resistant slip layer as described in Example B1 was previously formed on the other side of the substrate. A dye layer was formed in the same manner as in Example B1, except that the dye layer was formed directly on the substrate in its easy-adhesion treated face without the provision of any adhesive layer. Thus, a thermal transfer sheet of Comparative Example B1 was prepared.

Comparative Example B2

The same easy-adhesion treated PET film substrate as used in Example B1 was provided, and a heat-resistant slip layer as described in Example B1 was previously formed on the other side of the substrate. A dye layer was formed in the same manner as in Example B4, except that the dye layer was formed directly on the substrate in its easy-adhesion treated face without the provision of any adhesive layer. Thus, a thermal transfer sheet of Comparative Example B2 was prepared.

Comparative Example B3

The same easy-adhesion treated PET film substrate as used in Example B1 was provided, and a heat-resistant slip layer as described in Example B1 was previously formed on the other side of the substrate. A dye layer was formed in the same manner as in Example B5, except that the dye layer was formed directly on the substrate in its easy-adhesion treated face without the provision of any adhesive layer. Thus, a thermal transfer sheet of Comparative Example B3 was prepared.

Comparative Example B4

The same easy-adhesion treated PET film substrate as used in Example B1 was provided, and a heat-resistant slip layer as described in Example B1 was previously formed on the other side of the substrate. A dye layer was formed in the same manner as in Example B6, except that the dye layer was formed directly on the substrate in its easy-adhesion treated face without the provision of any adhesive layer. Thus, a thermal transfer sheet of Comparative Example B4 was prepared.

Comparative Example B5

The same PET film substrate subjected to corona irradiation treatment as used in Example B14 was provided, and a heat-resistant slip layer as described in Example B1 was previously formed on the other side of the substrate. A dye layer was formed in the same manner as in Example B1, except that the dye layer was formed directly on the substrate in its side subjected to corona irradiation treatment without the provision of any adhesive layer. Thus, a thermal transfer sheet of Comparative Example B5 was prepared.

Comparative Example B6

The same PET film substrate subjected to plasma irradiation treatment as used in Example B16 was provided, and a heat-resistant slip layer as described in Example B1 was previously formed on the other side of the substrate. A dye layer was formed in the same manner as in Example B1, except that the dye layer was formed directly on the substrate in its side subjected to plasma irradiation treatment without the provision of any adhesive layer. Thus, a thermal transfer sheet of Comparative Example B6 was prepared.

Comparative Example B7

The same easy-adhesion treated PET film substrate as used in Example B1 was provided. A heat-resistant slip layer as described in Example B1 was previously formed on the other side of the substrate. A coating liquid O having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Comparative Example B7 was prepared.

| <Composition of coating liquid O for adhesive layer> | |
|---|---|
| Polyester resin (RV 220, manufactured by Toyobo Co., Ltd.) | 6 parts |
| Toluene | 47 parts |
| Methyl ethyl ketone | 47 parts |

Comparative Example B8

The same easy-adhesion treated PET film substrate as used in Example B1 was provided. A heat-resistant slip layer as described in Example B1 was previously formed on the other side of the substrate. A coating liquid P having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Comparative Example B8 was prepared.

| <Composition of coating liquid P for adhesive layer> | |
|---|---|
| Polyurethane resin (SUPERFLEX 460 S, manufactured by Dai-Ichi Kogyo Seiyaku Co., Ltd.) | 6 parts |
| Water | 47 parts |
| Isopropyl alcohol | 47 parts |

Comparative Example B9

The same easy-adhesion treated PET film substrate as used in Example B1 was provided. A heat-resistant slip layer as described in Example B1 was previously formed on the other side of the substrate. A coating liquid Q having the following composition for an adhesive layer was gravure coated onto the easy-adhesion treated face in the substrate at a coverage of 0.2 g/m$^2$ on a dry basis, and the coating was dried to form an adhesive layer. A dye layer was formed on the adhesive layer in the same manner as in Example B1. Thus, a thermal transfer sheet of Comparative Example B9 was prepared.

| <Composition of coating liquid Q for adhesive layer> | |
|---|---|
| Acrylic resin (ME-18, manufactured by Nagase ChemteX Corporation) | 6 parts |
| Water | 47 parts |
| Isopropyl alcohol | 47 parts |

Comparative Example B10

The same PET film substrate subjected to corona irradiation treatment as used in Example B14 was provided. A heat-resistant slip layer as described in Example B1 was previously formed on the other side of the substrate. An adhesive layer was formed on the substrate in its side subjected to corona irradiation treatment in the same manner as in Comparative Example B7. A dye layer was then formed on the adhesive layer in the same manner as in Example B1. Thus, a thermal transfer sheet of Comparative Example B10 was prepared.

Comparative Example B11

The same PET film substrate subjected to corona irradiation treatment as used in Example B14 was provided. A heat-resistant slip layer as described in Example B1 was previously formed on the other side of the substrate. A coating liquid R having the following composition for an adhesive layer was gravure coated at a coverage of 0.2 g/m$^2$ on a dry basis onto the substrate in its side subjected to corona irradiation treatment, and the coating was dried to form an adhesive layer. A dye layer was then formed on the adhesive layer in the same manner as in Example B1. Thus, a thermal transfer sheet of Comparative Example B11 was prepared.

| <Composition of coating liquid R for adhesive layer> | |
|---|---|
| Polyester resin (MD-1245, manufactured by Toyobo Co., Ltd.) | 6 parts |
| Water | 47 parts |
| Isopropyl alcohol | 47 parts |

Comparative Example B12

The same untreated PET film substrate as used in Example B17 was provided. A heat-resistant slip layer as described in Example B1 was previously formed on the other side of the substrate. An adhesive layer was formed on the untreated face in the substrate in the same manner as in Comparative Example B7. Further, a dye layer was formed on the adhesive layer in the same manner as in Example B1. Thus, a thermal transfer sheet of Comparative Example B12 was prepared.

Comparative Example B13

A thermal transfer sheet prepared in Comparative Example B1 was provided. In the following evaluation, however, unlike Comparative Example B1, a polyvinyl chloride resin (PVC) card was used as a thermal transfer image-receiving sheet used in combination with the thermal transfer sheet.

Comparative Example B14

A thermal transfer sheet prepared in Comparative Example B5 was provided. In the following evaluation, however, unlike Comparative Example B5, a polyvinyl chloride resin (PVC) card was used as a thermal transfer image-receiving sheet used in combination with the thermal transfer sheet.

The thermal transfer sheets prepared in the above examples and comparative examples were evaluated for density, suitability for printing, and heat-resistant adhesion by the following methods.

(Evaluation of Density)

Printing was carried out under the following conditions, and the maximum density of the print was measured.

The thermal transfer sheets prepared in Examples B1 to B5 and B7 to B25 and Comparative Examples B1 to B3 and B5 to B12 were used in combination with a specialty standard set of printing paper for a digital color printer P-200, manufactured by Olympus Optical Co., LTD. A black blotted image (gradation value 255/255: density max) print pattern was printed with a digital color printer P-200, manufactured by Olympus Optical Co., LTD., and the maximum density in the printed portion was measured with a Macbeth densitometer RD-918, manufactured by Sakata INX Corp.

The thermal transfer sheets prepared in Example B6 and Comparative Example B4 were used in combination with standard printing paper (C-A6-PH) for a photochelate printer A6 (CHC-S1045-5E) manufactured by Konica Corp. A black blotted image (gradation value 255/255: density max) print pattern was printed with a photochelate printer A6 (CHC-S1045-5E) manufactured by Konica Corp., and the maximum density in the printed portion was measured with a Macbeth densitometer RD-918, manufactured by Sakata INX Corp.

Further, the thermal transfer sheets prepared in Examples B26 and B27 and Comparative Examples B13 and B14 were used in combination with a polyvinyl chloride resin (PVC) card. A black blotted image (gradation value 255/255: density max) print pattern was printed with a card printer P 310 manufactured by Eltron, and the maximum density in the printed portion was measured with a Macbeth densitometer RD-918, manufactured by Sakata INX Corp.

<Evaluation Criteria>

Relative to the maximum density of a reference ribbon (a ribbon wherein an adhesive layer is not sandwiched between the dye layer and the substrate), ◎: Maximum density of not less than 110%

○: Maximum density of not less than 100% and less than 110%

Δ: Maximum density of not less than 90% and less than 100%

X: Maximum density of less than 90%

The reference ribbon had the same dye layer, was not provided with the adhesive layer, and was used in combination with the same object.

Specifically, the reference for Examples B1, B2, B3, and B7 to B25 was Comparative Example B1, the reference for Example B4 was Comparative Example B2, the reference for Example B5 was Comparative Example B3, the reference for Example B6 was Comparative Example B4, the reference for Comparative Examples B5 to B12 was Comparative Example B1, and the reference for Examples B26 and B27 was Comparative Example B13.

(Suitability for Printing)

Printing was carried out in the same manner as used in the evaluation of the density. At that time, visual inspection was carried out for defective printing such as abnormal transfer, uneven transfer, or omission of transfer.

The results were evaluated according to the following criteria.

○: Defective printing phenomena such as abnormal transfer, uneven transfer, and omission of transfer did not occur.

X: Defective printing phenomenon such as abnormal transfer, uneven transfer, or omission of transfer occurred.

(Heat-Resistant Adhesion)

Each of the thermal transfer sheets as samples prepared in the examples and the comparative examples was applied onto a mount so that the surface of the dye layer faced upward, that is, so that the heat-resistant slip layer was brought into contact with the mount. A reference ribbon (a ribbon as described in the evaluation of the density, that is, a ribbon having the same dye layer and not provided with any adhesive layer) corresponding to the sample was applied onto the identical mount at its position different from the position of the sample so that the surface of the dye layer faced upward. Each mount was folded back so that dye layer surface in the sample and the dye layer surface in the reference ribbon were put on top of and brought into contact with each other. In this state, heat sealing was carried out under conditions of temperature 100 to 130° C., pressure 2.5 $kg/cm^2$, and pressing time 2 sec, followed by separation. The assembly was then visually inspected for residual dye layer (undesired transfer of dye layer) in each of the sample and the reference ribbon. The results were evaluated according to the following criteria.

○: The area of the dye layer remaining on the sample side is larger than the area of the dye layer remaining on the reference ribbon side.

X: The area of the dye layer remaining on the sample side is smaller than the area of the dye layer remaining on the reference ribbon side.

The results of evaluation for the examples and the comparative examples are shown in Table B1 below.

TABLE B1

| | Heat-resistant slip layer | Substrate | Adhesive layer | Coverage of adhesive layer, g/m$^2$ | Dye layer | Object | Evaluation of density | Suitability for printing | Heat-resistant adhesion |
|---|---|---|---|---|---|---|---|---|---|
| Ex. B1 | | Easy-adhesion treated raw film | A | 0.2 | 1 | Image-receiving paper | ◎ | ○ | ○ |
| Ex. B2 | | Easy-adhesion treated raw film | A | 0.03 | 1 | Image-receiving paper | ◎ | ○ | ○ |
| Ex. B3 | | Easy-adhesion treated raw film | A | 0.7 | 1 | Image-receiving paper | ◎ | ○ | ○ |
| Ex. B4 | | Easy-adhesion treated raw film | A | 0.2 | 2 | Image-receiving paper | ◎ | ○ | ○ |
| Ex. B5 | | Easy-adhesion treated raw film | A | 0.2 | 3 | Image-receiving paper | ◎ | ○ | ○ |
| Ex. B6 | | Easy-adhesion treated raw film | A | 0.2 | 4 | Image-receiving paper | ◎ | ○ | ○ |
| Ex. B7 | | Easy-adhesion treated raw film | B | 0.2 | 1 | Image-receiving paper | ◎ | ○ | ○ |
| Ex. B8 | | Easy-adhesion treated raw film | C | 0.2 | 1 | Image-receiving paper | ◎ | ○ | ○ |
| Ex. B9 | | Easy-adhesion treated raw film | D | 0.2 | 1 | Image-receiving paper | ○ | ○ | ○ |
| Ex. B10 | | Easy-adhesion treated raw film | E | 0.2 | 1 | Image-receiving paper | ◎ | ○ | ○ |
| Ex. B11 | a | Easy-adhesion treated raw film | F | 0.2 | 1 | Image-receiving paper | ◎ | ○ | ○ |
| Ex. B12 | | Easy-adhesion treated raw film | G | 0.2 | 1 | Image-receiving paper | ◎ | ○ | ○ |
| Ex. B13 | | Easy-adhesion treated raw film | H | 0.2 | 1 | Image-receiving paper | Δ | ○ | ○ |
| Ex. B14 | | Corona treated | A | 0.2 | 1 | Image-receiving paper | ◎ | ○ | ○ |
| Ex. B15 | | Corona treated | B | 0.2 | 1 | Image-receiving paper | ◎ | ○ | ○ |
| Ex. B16 | | Plasma treated | A | 0.2 | 1 | Image-receiving paper | ◎ | ○ | ○ |
| Ex. B17 | | Untreated raw film | E | 0.2 | 1 | Image-receiving paper | ◎ | ○ | ○ |
| Ex. B18 | | Untreated raw film | I | 0.2 | 1 | Image-receiving paper | ○ | ○ | ○ |
| Ex. B19 | | Untreated raw film | F | 0.2 | 1 | Image-receiving paper | ◎ | ○ | ○ |
| Ex. B20 | | Untreated raw film | J | 0.2 | 1 | Image-receiving paper | ○ | ○ | ○ |
| Ex. B21 | | Untreated raw film | G | 0.2 | 1 | Image-receiving paper | ◎ | ○ | ○ |
| Ex. B22 | | Untreated raw film | K | 0.2 | 1 | Image-receiving paper | ○ | ○ | ○ |
| Ex. B23 | | Untreated raw film | L | 0.2 | 1 | Image-receiving paper | Δ | ○ | ○ |
| Ex. B24 | | Untreated raw film | M | 0.2 | 1 | Image-receiving paper | Δ | ○ | ○ |
| Ex. B25 | a | Untreated raw film | N | 0.2 | 1 | Image-receiving paper | Δ | ○ | ○ |
| Ex. B26 | | Easy-adhesion treated raw film | A | 0.2 | 1 | PVC card | ◎ | ○ | ○ |
| Ex. B27 | | Corona treated | A | 0.2 | 1 | PVC card | ◎ | ○ | ○ |
| Comp. Ex. B1 | | Easy-adhesion treated raw film | None | — | 1 | Image-receiving paper | Control | ○ | Control |
| Comp. Ex. B2 | | Easy-adhesion treated raw film | None | — | 2 | Image-receiving paper | Control | ○ | Control |
| Comp. Ex. B3 | | Easy-adhesion treated raw film | None | — | 3 | Image-receiving paper | Control | ○ | Control |
| Comp. Ex. B4 | | Easy-adhesion treated raw film | None | — | 4 | Image-receiving paper | Control | ○ | Control |
| Comp. Ex. B5 | | Corona treated | None | — | 1 | Image-receiving paper | -(Impossible to print)*1 | X | X |
| Comp. Ex. B6 | | Plasma treated | None | — | 1 | Image-receiving paper | -(Impossible to print)*1 | X | X |
| Comp. Ex. B7 | | Easy-adhesion treated raw film | O | 0.2 | 1 | Image-receiving paper | X | ○ | X |
| Comp. Ex. B8 | a | Easy-adhesion treated raw film | P | 0.2 | 1 | Image-receiving paper | Δ | ○ | X |
| Comp. Ex. B9 | | Easy-adhesion treated raw film | Q | 0.2 | 1 | Image-receiving paper | Δ | ○ | X |
| Comp. Ex. B10 | | Corona treated | O | 0.2 | 1 | Image-receiving paper | X | ○ | X |
| Comp. Ex. B11 | | Corona treated | R | 0.2 | 1 | Image-receiving paper | Δ | ○ | X |

TABLE B1-continued

| | Heat-resistant slip layer | Substrate | Adhesive layer | Coverage of adhesive layer, g/m$^2$ | Dye layer | Object | Evaluation of density | Suitability for printing | Heat-resistant adhesion |
|---|---|---|---|---|---|---|---|---|---|
| Comp. Ex. B12 | | Untreated raw film | O | 0.2 | ① | Image-receiving paper | X | ○ | X |
| Comp. Ex. B13 | | Easy-adhesion treated raw film | None | — | ① | PVC card | Control | ○ | Control |
| Comp. Ex. B14 | | Corona treated | None | — | ① | PVC card | -(Impossible to print)*1 | X | X |

*1: The density could not be evaluated due to abnormal transfer in the printing.

As is apparent from the results of evaluation of density, in the examples wherein the adhesive layer contained polyvinylpyrrolidone resin, the thermal transfer sheets had high transfer sensitivity in printing and could yield prints having high print density. In the above heat-resistant adhesion, the adhesion between the dye layer and the substrate under a high temperature is examined. That is, the heat-resistant adhesion is an evaluation associated with the prevention of abnormal transfer in thermal transfer printing. The thermal transfer sheets prepared in the examples of the present invention had excellent heat-resistant adhesion and did not cause defective printing phenomena such as abnormal transfer, uneven transfer, and omission of transfer.

In Example B13 wherein the adhesion layer was formed of polyvinylpyrrolidone having a K value of 30 alone, both the suitability for printing and the heat-resistant adhesion were excellent, although the maximum density was somewhat lower than that in the case of the reference ribbon (thermal transfer sheet prepared in Comparative Example B1).

In Examples B23, B24, and B25 wherein 35% by weight, based on the solid content of the whole adhesive layer, of an adhesive component was contained in polyvinylpyrrolidone, both the suitability for printing and the heat-resistant adhesion were excellent, although the maximum density was somewhat lower than that in the case of the reference ribbon (thermal transfer sheet prepared in Comparative Example B1).

As described above, in the thermal transfer sheet according to the present invention comprising a substrate, a heat-resistant slip layer provided on one side of the substrate, and an adhesive layer and a dye layer provided in that order on the other side of the substrate, since the adhesive layer contains a polyvinylpyrrolidone resin, the transfer sensitivity in thermal transfer can be significantly improved and a high-density thermally transferred image can be yielded without the application of high energy. When the adhesive layer contains other adhesive component(s) in addition of a polyvinylpyrrolidone resin, the adhesion between the dye layer and the substrate can be enhanced even in the case where the substrate has not been subjected to adhesion treatment. This can contribute to the prevention of abnormal transfer and the like.

What is claimed is:

1. A thermal transfer sheet comprising: a substrate; a dye layer of at least one color and a thermally transferable protective layer provided in a face serial manner on one side of the substrate; the protective layer provided on a part of one side of the substrate; and an easy-adhesion layer provided on the whole surface of the protective layer and the substrate, the dye layer being provided on the easy-adhesion layer in its region where the protective layer is not located on the underside of the easy-adhesion layer.

2. The thermal transfer sheet according to claim 1, wherein the easy-adhesion layer comprises a homopolymer of N-vinylpyrrolidone and/or a copolymer of N-vinylpyrrolidone with other component(s).

3. The thermal transfer sheet according to claim 1, wherein an adhesive layer is provided on the easy-adhesion layer in its region where the protective layer is located on the underside of the easy-adhesion layer.

4. The thermal transfer sheet according to claim 1, wherein a detection mark is provided between the dye layer and the thermally transferable protective layer and/or between the dye layer of a plurality of colors.

5. The thermal transfer sheet according to claim 1, wherein the sheet further comprises a primer layer having a thickness of 0.02 to 1 g/m$^2$.

6. A thermal transfer sheet comprising: a substrate, a heat-resistant slip layer provided on one side of the substrate; and an adhesive layer and a dye layer provided in that order on the other side of the substrate, the adhesive layer comprising a polyvinylpyrrolidone resin havina a K value in the Fikentscher's formula of not less than 60.

7. The thermal transfer sheet according to claim 6, wherein the adhesive layer comprises an adhesive component in addition to the polyvinylpyrrolidone resin.

8. The thermal transfer sheet according to claim 7, wherein the adhesive component is contained in an amount of 1 to 30% by weight on a solid basis of the whole adhesive layer.

9. The thermal transfer sheet according to claim 7, wherein the substrate on its surface where the dye layer is provided has not been subjected to adhesion treatment.

10. The thermal transfer sheet according to claim 6, wherein the substrate on its surface where the dye layer is provided has been subjected to adhesion treatment.

11. The thermal transfer sheet according to claim 6, wherein the sheet further comprises a primer layer having a thickness of 0.02 to 1 g/m$^2$.

* * * * *